US010753152B1

(12) United States Patent
Ritchie et al.

(10) Patent No.: US 10,753,152 B1
(45) Date of Patent: Aug. 25, 2020

(54) ROTOR CATCH FOR BOTTOMHOLE ASSEMBLY

(71) Applicant: TURBO DRILL INDUSTRIES, INC., Conroe, TX (US)

(72) Inventors: Sheldon Ritchie, Conroe, TX (US); Chad Feddema, Conroe, TX (US)

(73) Assignee: TURBO DRILL INDUSTRIES, INC., Conroe, TX (US)

( * ) Notice: Subject to any disclaimer, the term of this patent is extended or adjusted under 35 U.S.C. 154(b) by 0 days.

(21) Appl. No.: 16/738,607

(22) Filed: Jan. 9, 2020

(51) Int. Cl.

| | |
|---|---|
| ***E21B 4/02*** | (2006.01) |
| ***E21B 34/14*** | (2006.01) |
| ***E21B 34/10*** | (2006.01) |
| ***E21B 34/06*** | (2006.01) |

(52) U.S. Cl.
CPC ..... *E21B 4/02* (2013.01); *E21B 34/063* (2013.01); *E21B 34/103* (2013.01); *E21B 34/14* (2013.01)

(58) Field of Classification Search
CPC ..... E21B 4/02
See application file for complete search history.

(56) References Cited

U.S. PATENT DOCUMENTS

| | | | | |
|---|---|---|---|---|
| 6,540,020 | B1 * | 4/2003 | Falgout, Sr. | E21B 4/02 166/250.01 |
| 7,063,175 | B1 * | 6/2006 | Kerstetter | E21B 17/03 175/107 |
| 7,234,545 | B2 * | 6/2007 | Pinol | E21B 4/02 175/107 |
| 9,194,181 | B2 | 11/2015 | Connell et al. | |
| 9,540,877 | B2 * | 1/2017 | Lanning | E21B 21/103 |
| 9,695,638 | B2 * | 7/2017 | Murray | E21B 4/02 |
| 10,053,918 | B2 * | 8/2018 | SadAbadi | E21B 12/00 |
| 10,465,510 | B2 | 11/2019 | Baudoin | |
| 2016/0281429 | A1 * | 9/2016 | Wilson | E21B 4/02 |
| 2018/0305988 | A1 * | 10/2018 | Gharib | E21B 4/02 |
| 2020/0018120 | A1 * | 1/2020 | Riddel | E21B 21/08 |

* cited by examiner

*Primary Examiner* — D. Andrews
(74) *Attorney, Agent, or Firm* — Adolph Locklar

(57) ABSTRACT

A rotor catch assembly includes a rotor catch housing and a rotor catch stem. The rotor catch housing is tubular and includes a landing ring formed on an inner surface thereof. The rotor catch stem is tubular and includes an annular landing flange about the rotor catch stem. The landing flange is positioned within the bore of the rotor catch housing above the landing ring. The interior of the rotor catch stem defines a rotor catch stem bore, which is coupled to the bore of the rotor catch housing below the landing ring by a rotor catch nozzle. The rotor catch stem includes a piston assembly, burst disk assembly, or nozzle assembly positioned to reduce or stop flow through the rotor catch stem bore through the rotor catch nozzle until the landing flange of the rotor catch stem lands on the landing ring of the rotor catch housing.

15 Claims, 18 Drawing Sheets

ROTOR CATCH FOR BOTTOMHOLE ASSEMBLY

TECHNICAL FIELD/FIELD OF THE DISCLOSURE

The present disclosure relates generally to downhole tools, and specifically to rotor catches for downhole motors.

BACKGROUND OF THE DISCLOSURE

Many downhole tools include downhole motors. Typically, the downhole motors are progressing cavity motors that include a rotor positioned within a stator with rotating components of the bottomhole assembly (BHA) coupled directly to the rotor. In some cases, one or more components of the BHA used to retain the rotor and rotating components to the rest of the drill string may fail during operation of the BHA. A rotor catch is typically installed above the rotor to retain the rotating components of the BHA and the rotor to the rest of the drill string when the drill string is removed from the wellbore in such an eventuality. The rotor catch typically includes a rotor catch stem coupled to the rotor that is positioned within a rotor catch housing configured such that the rotor and rotating components of the BHA are pulled out of the wellbore despite the failure of the other retaining components of the BHA.

SUMMARY

The present disclosure provides for a rotor catch assembly. The rotor catch assembly may include a rotor catch housing, the rotor catch housing being tubular and including a landing ring formed on an inner surface of the rotor catch housing. The interior of the rotor catch housing above the landing ring may define an upper rotor catch housing bore, and the interior of the rotor catch housing below the landing ring defining a lower rotor catch housing bore. The rotor catch assembly may include a rotor catch stem, the rotor catch stem being tubular. The interior of the rotor catch stem may define a rotor catch stem bore. The rotor catch stem may include a landing flange, the landing flange being an annular projection about an upper end of the rotor catch stem. The rotor catch stem may be positioned within the rotor catch housing such that the landing flange is positioned in the upper rotor catch housing bore. The rotor catch stem may include a rotor catch nozzle, the rotor catch nozzle providing a flowpath between the rotor catch stem bore and the lower rotor catch housing bore. The rotor catch assembly may include a piston assembly including a piston and a shear pin. The piston may be positioned within the rotor catch stem bore. The shear pin may be coupled between the rotor catch stem and the piston such that the flowpath through the rotor catch stem bore is closed while the piston is coupled to the rotor catch stem by the shear pin.

The present disclosure also provides for a rotor catch assembly. The rotor catch assembly may include a rotor catch housing, the rotor catch housing being tubular and including a landing ring formed on an inner surface of the rotor catch housing. The interior of the rotor catch housing above the landing ring may define an upper rotor catch housing bore, and the interior of the rotor catch housing below the landing ring defining a lower rotor catch housing bore. The rotor catch assembly may include a rotor catch stem, the rotor catch stem being tubular. The interior of the rotor catch stem may define a rotor catch stem bore. The rotor catch stem may include a landing flange, the landing flange being an annular projection about an upper end of the rotor catch stem. The rotor catch stem may be positioned within the rotor catch housing such that the landing flange is positioned in the upper rotor catch housing bore. The rotor catch stem may include a rotor catch nozzle, the rotor catch nozzle providing a flowpath between the rotor catch stem bore and the lower rotor catch housing bore. The rotor catch assembly may include a burst disk assembly including a burst disk and a burst disk housing. The burst disk housing may be coupled to the rotor catch stem such that the burst disk is held in the rotor catch stem bore such that the flowpath through the rotor catch stem bore is closed while the burst disk is intact.

The present disclosure also provides for a rotor catch assembly. The rotor catch assembly may include a rotor catch housing, the rotor catch housing being tubular and including a landing ring formed on an inner surface of the rotor catch housing. The interior of the rotor catch housing above the landing ring may define an upper rotor catch housing bore, and the interior of the rotor catch housing below the landing ring defining a lower rotor catch housing bore. The rotor catch assembly may include a rotor catch stem, the rotor catch stem being tubular. The interior of the rotor catch stem may define a rotor catch stem bore. The rotor catch stem may include a landing flange, the landing flange being an annular projection about an upper end of the rotor catch stem. The rotor catch stem may be positioned within the rotor catch housing such that the landing flange is positioned in the upper rotor catch housing bore. The rotor catch stem may include a rotor catch nozzle, the rotor catch nozzle providing a flowpath between the rotor catch stem bore and the lower rotor catch housing bore. The rotor catch assembly may include a nozzle assembly. The nozzle assembly may include a nozzle body, the nozzle body being tubular. The interior of the nozzle body may define a nozzle bore. The nozzle body may be coupled to the rotor catch stem such that the nozzle bore defines a flowpath between the upper rotor catch housing bore and the rotor catch stem bore.

The present disclosure also provides for a method. The method may include positioning a bottomhole assembly (BHA) in a wellbore, the BHA coupled to a drill string, The BHA may include a power section including a stator and a rotor. The BHA may include a rotor catch. The rotor catch may include a rotor catch housing, the rotor catch housing being tubular. The rotor catch housing may include a landing ring formed on an inner surface of the rotor catch housing. The interior of the rotor catch housing above the landing ring may define an upper rotor catch housing bore, and the interior of the rotor catch housing below the landing ring may define a lower rotor catch housing bore. The rotor catch housing may be coupled to the stator. The rotor catch may include a rotor catch stem, the rotor catch stem being tubular. The interior of the rotor catch stem may define a rotor catch stem bore. The rotor catch stem may include a landing flange, the landing flange being an annular projection about an upper end of the rotor catch stem. The rotor catch stem may be positioned within the rotor catch housing such that the landing flange is positioned in the upper rotor catch housing bore. The rotor catch stem may include a rotor catch nozzle, the rotor catch nozzle providing a flowpath between the rotor catch stem bore and the lower rotor catch housing bore. The rotor catch stem may be coupled to the rotor. The rotor catch may include a restriction positioned within the rotor catch stem bore, the restriction reducing or preventing fluid flow through the rotor catch stem bore. The method may further include raising the BHA off the bottom of the wellbore, landing the landing flange of the rotor catch stem on the landing ring of the rotor catch housing, pumping fluid into the drill string, monitoring the standpipe pressure of the drill string, opening the restriction, and identifying that the restriction has opened.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
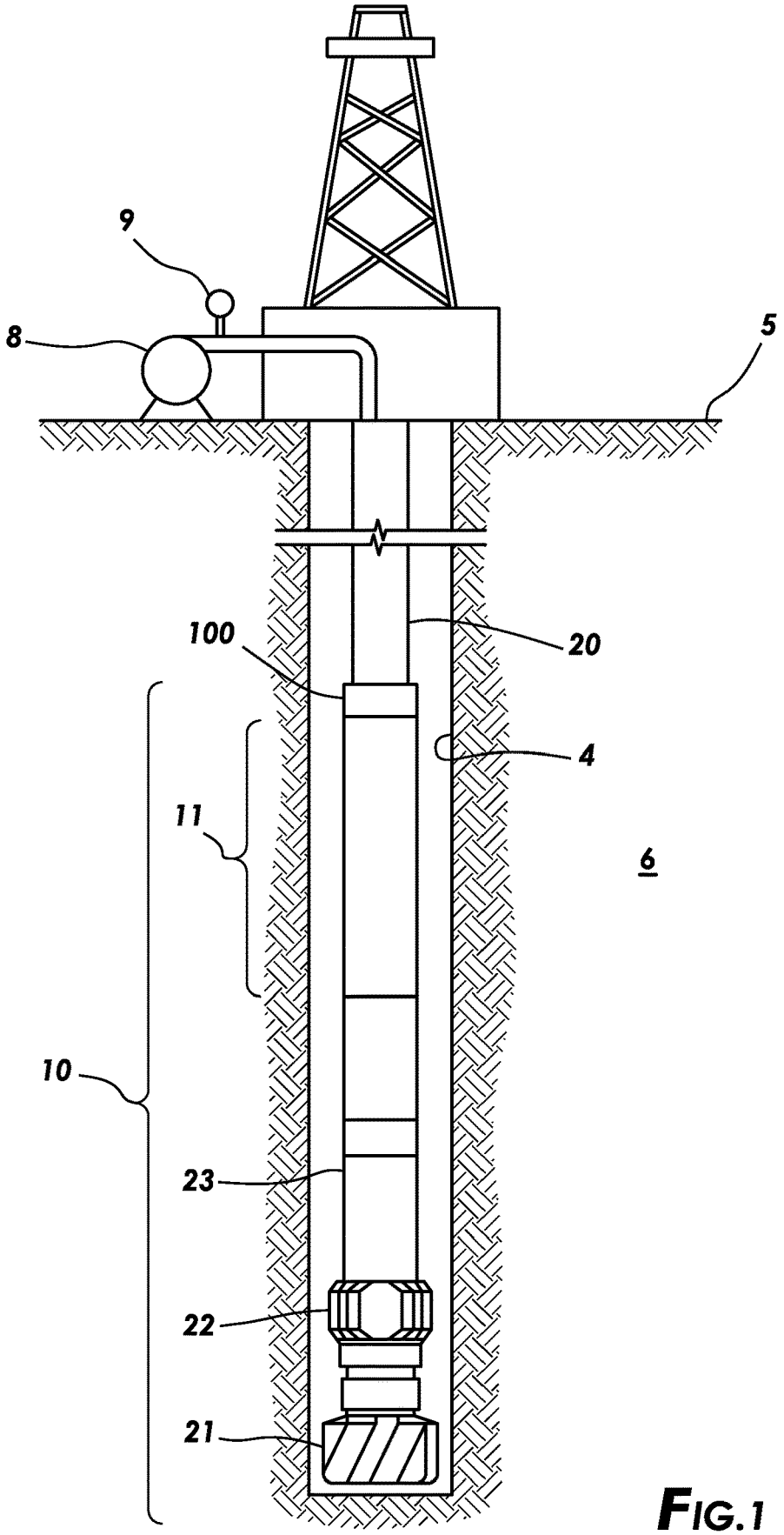
FIG. 1 is a schematic view of a drill string positioned in a wellbore, the drill string including a rotor catch assembly consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

For the purposes of the present disclosure, the terms "upper," "upward," and "above" refer to the relative direction as within a wellbore in a direction toward the surface regardless of the orientation of the wellbore. For the purposes of this disclosure, the terms "lower," "downward," and "below" refer to the relative direction as within a wellbore in a direction away from the surface regardless of the orientation of the wellbore.

FIG. 1 depicts wellbore 4 during a drilling operation of wellbore 4. Wellbore 4 may extend from surface 5 into earthen formation 6 and may be formed using drill string 20. One or more pumps 8 may be positioned at surface 5 in order to provide fluid flow through drill string 20 as further discussed herein below. In some embodiments, pressure gauge 9 may be positioned at surface 5 to measure the pressure within drill string 20, referred to herein as the standpipe pressure.

In some embodiments, drill string 20 may include bottomhole assembly (BHA) 10 positioned within wellbore 4. In some embodiments, bottomhole assembly 10 may include power section 11 which may include a downhole motor as further discussed herein below. In some embodiments, BHA 10 may include one or more rotating components including, for example and without limitation, drill bit 21 as well as additional components such as rotary steerable systems 22. The rotating components of BHA 10 may be secured to a rotor of power section 11. In some embodiments, BHA 10 may include one or more components configured to axially support the rotating components of BHA 10 when drill bit 21 is raised off the bottom of wellbore 4 including, for example and without limitation, bearing section 23. These components are referred to herein as the retention components of BHA 10.

Figure 2:
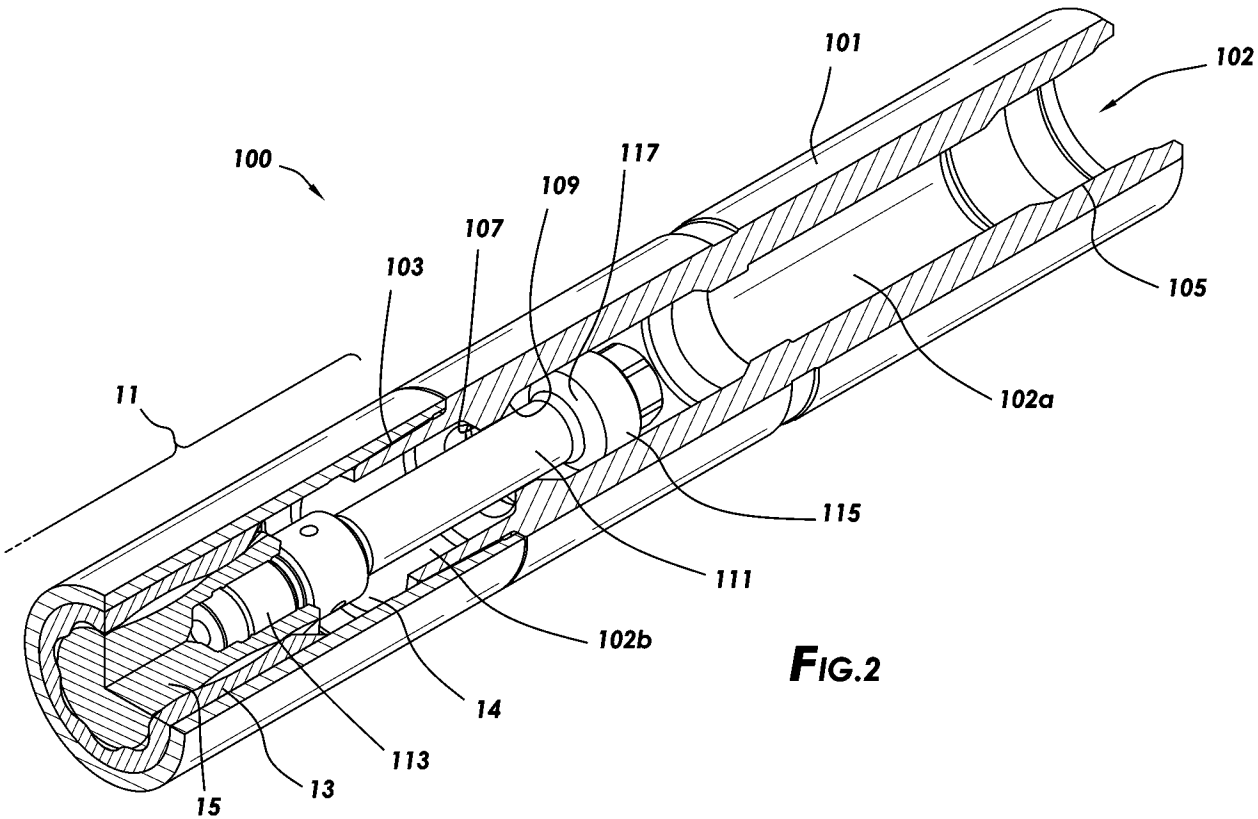
FIG. 2 is a perspective view of a rotor catch assembly consistent with at least one embodiment of the present disclosure.

FIG. 2 depicts rotor catch assembly 100. Rotor catch assembly 100 may include rotor catch housing 101. Rotor catch housing 101 may be tubular. The interior of rotor catch housing 101 may define rotor catch housing bore 102. In some embodiments, rotor catch housing 101 may mechanically couple to power section 11 of BHA 10. In some embodiments, power section 11 may include stator 13 and rotor 15. Stator 13 may be tubular and rotor 15 may be positioned within the bore of stator 13. In some embodiments, rotor 15 may be solid and may not include a bore therethrough. In some embodiments, fluid flow through rotor catch assembly including flow through rotor catch stem bore 119 may not flow through any bore formed in rotor 15. In some embodiments, rotor catch housing 101 may be coupled directly to stator 13 or may be coupled to stator 13 through one or more intermediary tubular members. Stator bore 14 of stator 13 may be in fluid communication with rotor catch housing bore 102 as further described below. In some embodiments, rotor catch housing 101 may be coupled to the upper end of stator 13 by lower coupler 103. In some embodiments, rotor catch housing 101 may include upper coupler 105 positioned to allow rotor catch housing 101 to couple to other tubular members of drill string 20 above BHA 10.

Rotor catch assembly 100 may include rotor catch stem 111. Rotor catch stem 111 may be positioned within rotor catch housing 101. In some embodiments, rotor catch stem 111 may include rotor coupler 113. In some embodiments, rotor 15 of power section 11 may be coupled to rotor catch stem 111 using rotor coupler 113.

Rotor catch stem 111 may include landing flange 115. In some embodiments, landing flange 115 may be an upset or outward radial extension of rotor catch stem 111 positioned above rotor coupler 113. Landing flange 115 may be formed integrally to rotor catch stem 111 or may be mechanically coupled to rotor catch stem 111. Landing flange 115 may be annular and may extend around the entire periphery of rotor catch stem 111.

In some embodiments, rotor catch housing 101 may include landing ring 107. Landing ring 107 may be an upset or inward radial extension of rotor catch housing 101 into the rotor catch housing bore 102. The portion of rotor catch housing bore 102 above landing ring 107 is referred to herein as upper rotor catch housing bore 102*a*, and the portion of rotor catch housing bore 102 below landing ring 107 is referred to herein as lower rotor catch housing bore 102*b*. Lower rotor catch housing bore 102*b* may be in fluid communication with stator bore 14.

Rotor catch stem 111 may be positioned within rotor catch housing 101 such that landing flange 115 is positioned above landing ring 107, i.e. within upper rotor catch housing bore 102*a*. In some embodiments, landing ring 107 may be configured such that landing flange 115 may not pass through landing ring 107. In such embodiments, downward movement of rotor catch stem 111 may be arrested by landing ring 107 as landing flange 115 abuts landing ring 107 as further discussed herein below. In some embodiments, landing flange 115 and landing ring 107 may include landing faces 117, 109, respectively, that are configured to abut upon engagement of landing flange 115 with landing ring 107, defining a landed position of rotor catch stem 111. In some embodiments, landing faces 109, 117 may be configured with corresponding geometry such that fluid flow between upper rotor catch housing bore 102*a* and lower rotor catch housing bore 102*b* is reduced or prevented while landing flange 115 is in abutment with landing ring 107. In some embodiments, landing faces 109, 117 may be tapered such that, for example and without limitation, rotor catch stem 111 is brought into alignment with rotor catch housing 101 when landing flange 115 contacts landing ring 107.

Figure 3:
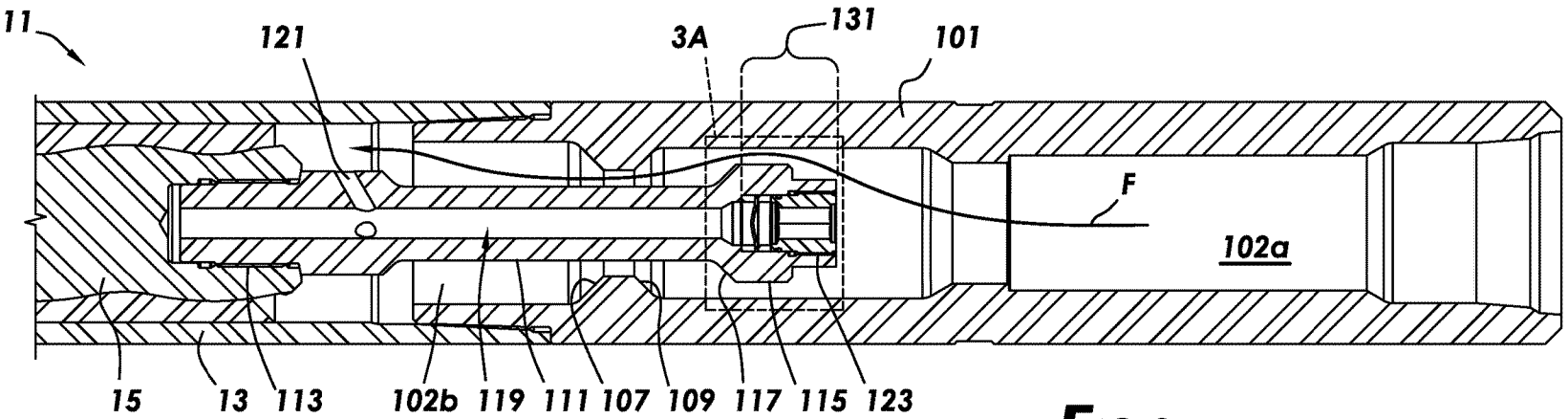
FIG. 3 is a cross section view of a rotor catch assembly consistent with at least one embodiment of the present disclosure during normal operation.

In some embodiments, as depicted in FIG. 3, rotor catch stem 111 may be tubular, the interior of which defining rotor catch stem bore 119. In some embodiments, one or more rotor catch nozzles 121 may be formed in rotor catch stem 111 to provide a flowpath between rotor catch stem bore 119 and lower rotor catch housing bore 102*b* or stator bore 14. In some embodiments, one or more restrictions may be positioned in rotor catch stem bore 119 to restrict or prevent flow through rotor catch stem bore 119 until rotor catch stem 111 is in the landed position and, in some embodiments, until the restriction is opened as further discussed below with respect to various embodiments of the present disclosure.

In some embodiments, the upper end of rotor catch stem 111 may include upper stem coupler 123. Upper stem coupler 123 may be positioned at the upper end of rotor catch stem bore 119.

Figure 3A:
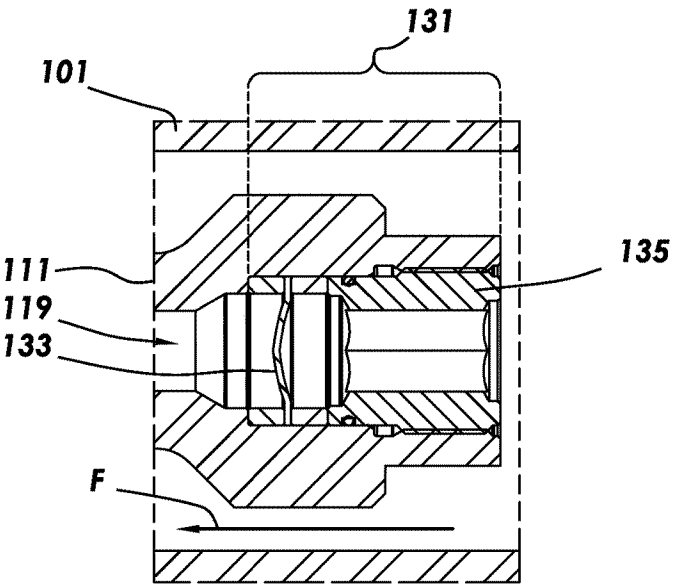
FIG. 3A is a detail view of the rotor catch assembly of FIG. 3.

In some embodiments, as depicted in FIGS. 3, 3A, burst disk assembly 131 may be coupled to upper stem coupler 123. Burst disk assembly 131 may include burst disk 133 and burst disk housing 135. Burst disk housing 135 may couple to upper stem coupler 123 and may retain burst disk 133 within rotor catch stem bore 119 such that burst disk 133 prevents fluid communication between upper rotor catch housing bore 102*a* and rotor catch stem bore 119 before rupture of burst disk 133. In some embodiments, as further discussed below, burst disk 133 may be configured to rupture and allow fluid flow from upper rotor catch housing bore 102*a* and rotor catch stem bore 119 once burst disk 133 is subjected to a preselected threshold bursting pressure between upper rotor catch housing bore 102*a* and rotor catch stem bore 119.

During normal operation as depicted in FIGS. 3, 3A, the retention components of BHA 10 properly retain rotor 15 in the proper position such that landing flange 115 of rotor catch stem 111 is positioned within upper rotor catch housing bore 102*a* spaced apart from landing ring 107 such that fluid may flow through landing ring 107 from upper rotor catch housing bore 102*a* to lower rotor catch housing bore 102*b* and into stator bore 14 regardless of whether BHA 10 is landed on the bottom of the wellbore or raised off bottom. Such flow, depicted by arrow F, may, for example and without limitation, be used to operate power section 11 of BHA 10 and any other equipment of BHA 10. During such normal operation, the pressure within upper rotor catch housing bore 102*a* and rotor catch stem bore 119 is equalized as rotor catch stem bore 119 is in fluid communication with lower rotor catch housing bore 102*b* through rotor catch nozzles 121. Therefore, during normal operation, burst disk 133 does not experience significant differential pressure and remains intact.

Figure 4:
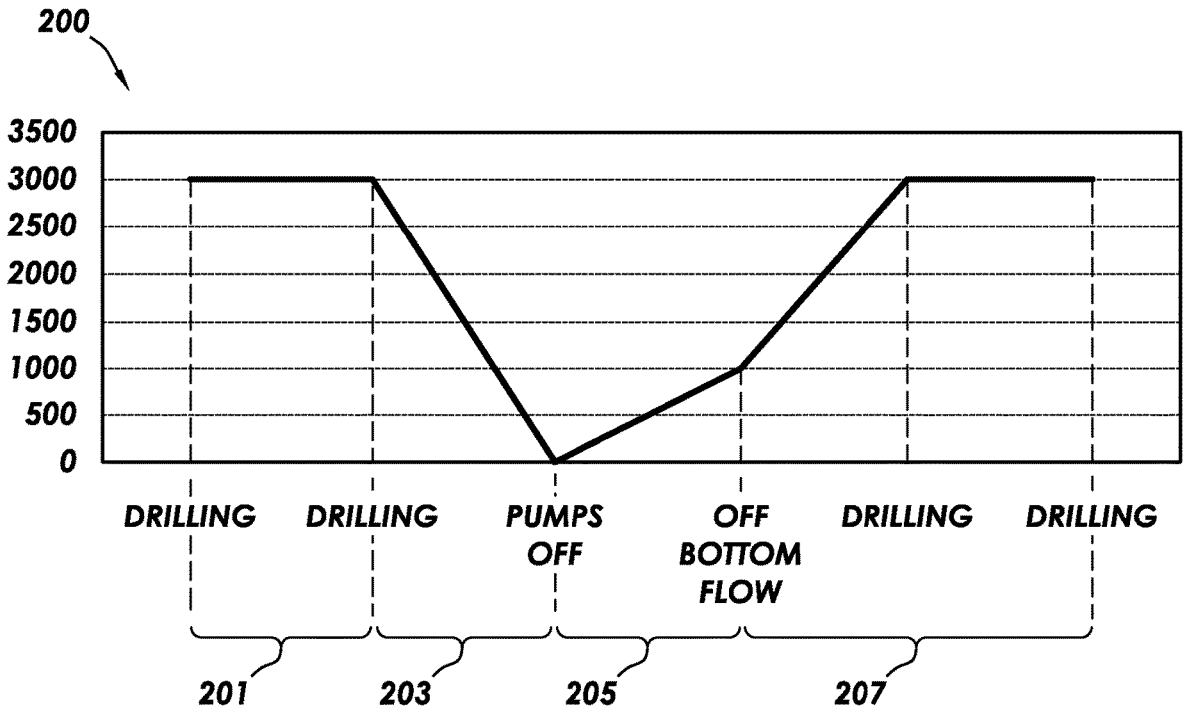
FIG. 4 is a pressure graph depicting expected pressures during a normal verification operation.

FIG. 4 depicts the standpipe pressure for drill string 20 coupled to BHA 10 during a normal BHA integrity verification operation (200). While drilling, the standpipe pressure remains generally consistent—shown as a nonlimiting example in FIG. 4 as 3000 psi (depicted at 201). During verification operation 200, drilling is stopped, and the pumps providing fluid flow through BHA 10 are disengaged (203). As shown, the standpipe pressure within drill string 20 is reduced. Drill string 20 may be moved upward within the wellbore such that BHA 10 is raised off the bottom of the wellbore, and the pumps may be reengaged (205). Where the retention components of BHA 10 are intact, fluid is able to flow through rotor catch assembly 100 as landing flange 115 is not in contact with landing ring 107, and the standpipe pressure increases. The fluid flow through BHA 10 may cause power section 11 to be activated. However, because BHA 10 is not in engagement with the bottom of the wellbore, the pressure differential across BHA 10 is lower as less torque is required to rotate the rotating components of BHA 10. Therefore, the standpipe pressure shown at 205 is lower than the standpipe pressure during the previous drilling operation shown at 201. Therefore, it can be determined that BHA 10 is operating normally. Drilling can then be resumed (207) by moving drill string 20 downward until BHA 10 is engaged to the bottom of the wellbore.

Figure 5:
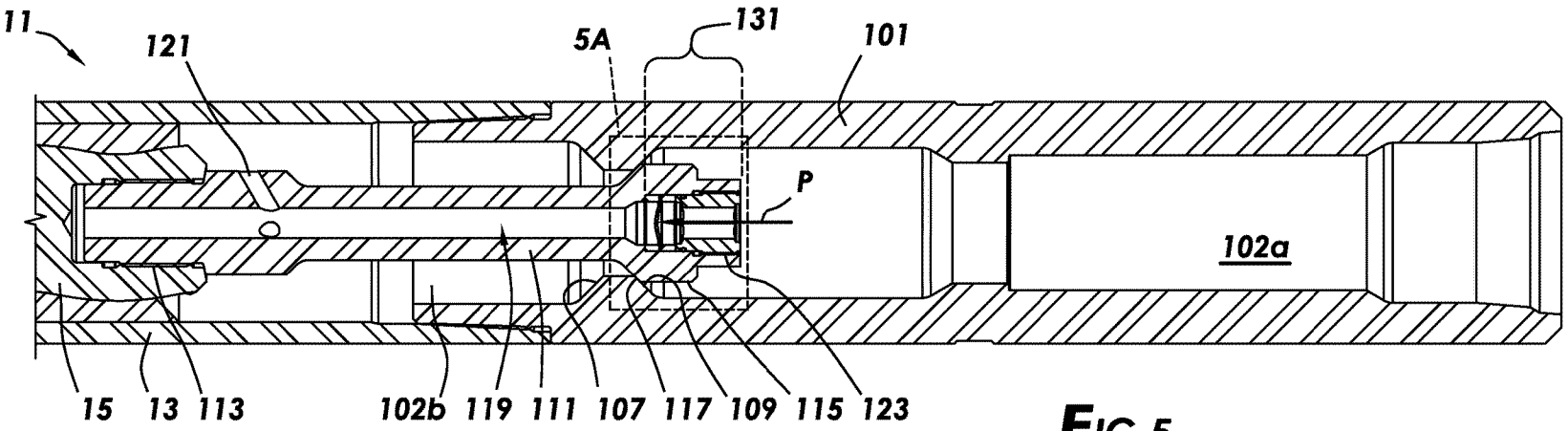
FIG. 5 is a cross section view of the rotor catch assembly of FIG. 3 in a landed position.
Figure 5A:
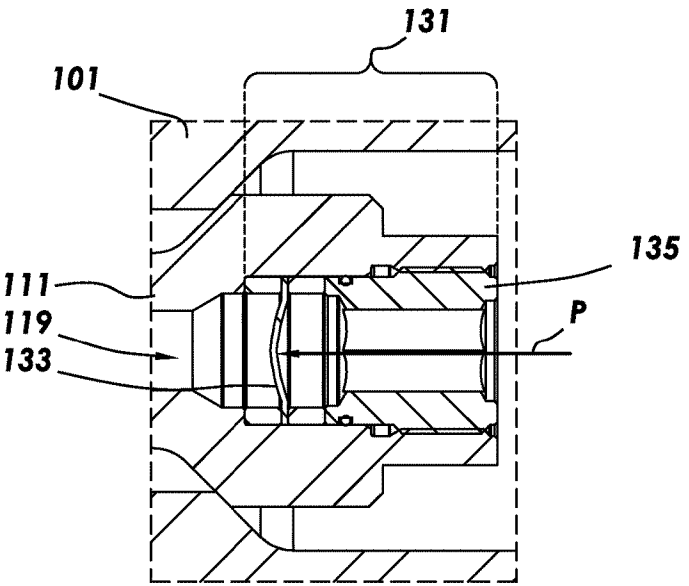
FIG. 5A is a detail view of the rotor catch assembly of FIG. 5.

In the event that the retention components of BHA 10 fail, when drill string 20 is moved upward, the rotating components of BHA 10 and rotor 15 may not be raised with the rest of drill string until landing flange 115 of rotor catch stem 111 engages landing ring 107 of rotor catch housing 101, defining a landed position of rotor catch stem 111 as shown in FIGS. 5, 5A. In such an event, landing faces 117, 109 of landing flange 115 and landing ring 107 may come into abutment, allowing rotor 15 and the other rotating components of BHA 10 to be raised with the rest of drill string 20 as landing flange 115 cannot pass through landing ring 107. In some embodiments, the weight of rotor 15 and the other rotating components of BHA 10 may maintain the engagement between landing flange 115 and landing ring 107 such that the flowpath between upper rotor catch housing bore 102*a* and lower rotor catch housing bore 102*b* is closed or restricted. In such a condition, because upper rotor catch housing bore 102*a* is fluidly isolated from lower rotor catch housing bore 102*b* and because rotor catch stem bore 119 is in fluid communication with lower rotor catch housing bore 102*b*, fluid pressure within upper rotor catch housing bore 102*a* is exerted on burst disk 133, depicted as pressure p.

Figure 6:
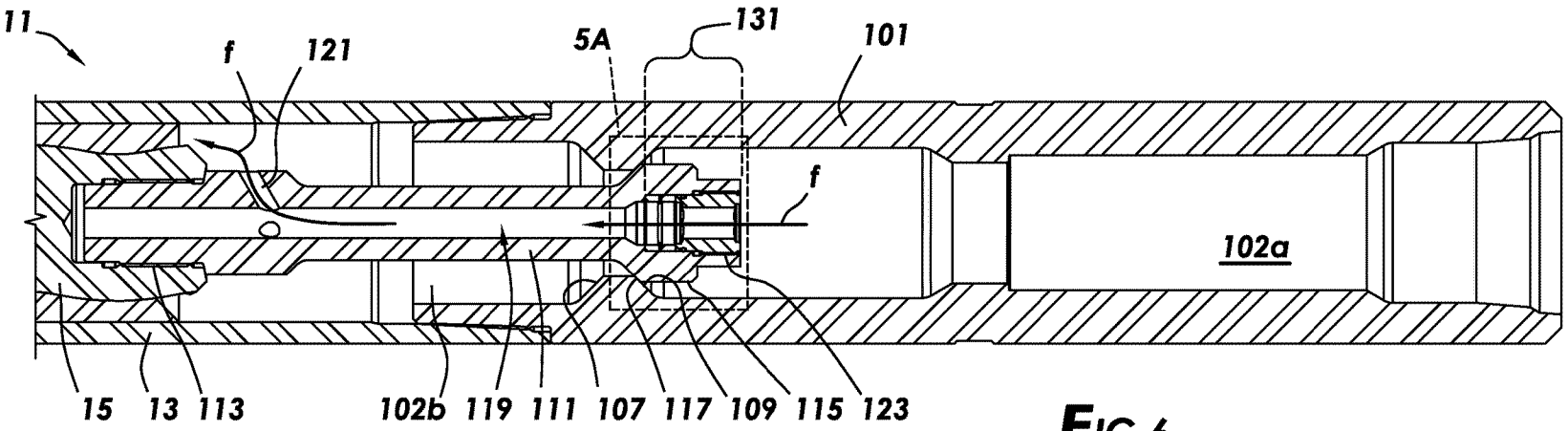
FIG. 6 is a cross section view of the rotor catch assembly of FIG. 5 after burst disk rupture.
Figure 6A:
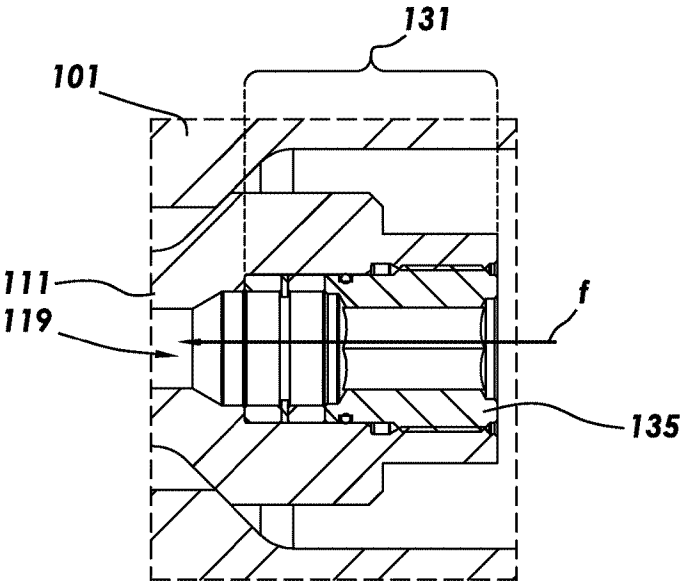
FIG. 6A is a detail view of the rotor catch assembly of FIG. 6.

Once the pressure differential across burst disk 133 exceeds the preselected threshold bursting pressure, burst disk 133 may rupture as shown in FIG. 6, 6A, allowing fluid to flow from upper rotor catch housing bore 102*a* to lower rotor catch housing bore 102*b* via rotor catch stem bore 119 and rotor catch nozzles 121, depicted as flow f. The rupture of burst disk 133 may cause a sudden change in standpipe pressure that is identifiable from the surface and may therefore allow an operator to identify that rotor catch stem 111 is in the landed position and that the retention components of BHA 10 have failed.

Figure 7:
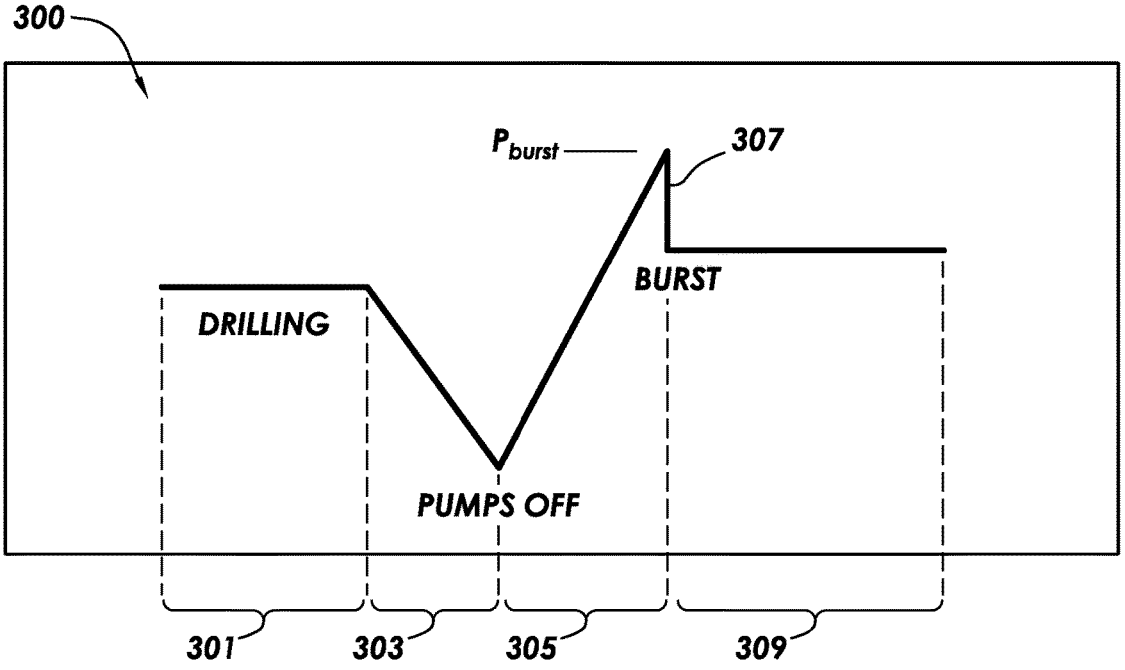
FIG. 7 is a pressure graph depicting expected pressures during a verification operation during which the burst disk ruptures.

FIG. 7 depicts the standpipe pressure for drill string 20 coupled to BHA 10 during a BHA integrity verification operation (300) in which the retention components of BHA 10 have failed. As discussed herein above with respect to FIG. 4, while drilling, the standpipe pressure remains generally consistent (depicted at 301). During verification operation 300, drilling is stopped, and the pumps providing fluid flow through BHA 10 are disengaged (303). As shown, the standpipe pressure within drill string 20 is reduced. Drill string 20 may be moved upward within the wellbore such that BHA 10 is raised off the bottom of the wellbore, and the pumps may be reengaged (305). However, unlike the normal operation described above with respect to FIG. 4, the standpipe pressure may increase to the preselected threshold bursting pressure ($P_{burst}$) at which point burst disk 133 ruptures. The rupturing of burst disk 133 results in a rapid reduction in standpipe pressure (307), after which the standpipe pressure remains relatively constant (309). By observing the rapid reduction in standpipe pressure once the standpipe pressure reaches the preselected threshold bursting pressure, it can be identified that rotor catch stem 111 is in the landed position and that the retention components of BHA 10 have failed.

In some embodiments, the preselected threshold bursting pressure may be above or below the expected standpipe pressures during the normal drilling operation as burst disk 133 does not experience a differential pressure during normal operations.

Remedial actions, including, for example, retrieving BHA 10 from the wellbore using rotor catch assembly 100 to support rotor 15 and other rotating components of BHA 10, may then be performed such that repairs to BHA 10 may be made. In some embodiments, because the flow path between upper rotor catch housing bore 102*a* and lower rotor catch housing bore 102*b* is open via rotor catch stem bore 119 and rotor catch nozzles 121, fluid circulation through BHA 10 may continue as BHA 10 is removed from the wellbore.

Figure 8:
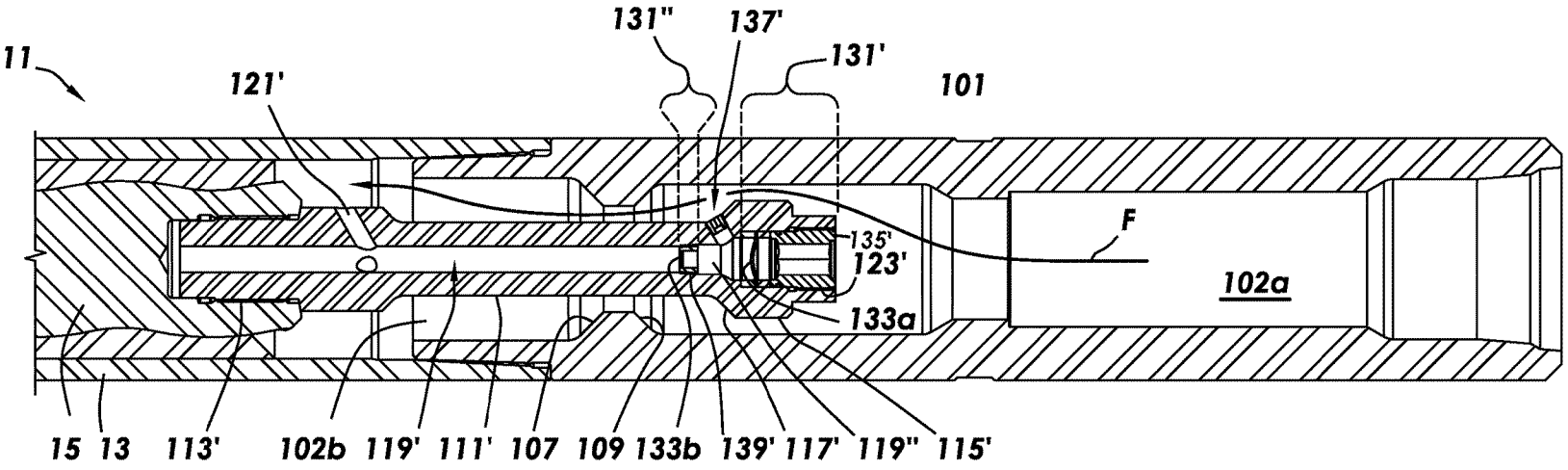
FIG. 8 is a cross section view of a rotor catch assembly consistent with at least one embodiment of the present disclosure.

In some embodiments, rotor catch assembly 100 may include multiple burst disks. For example, as shown in FIG. 8, burst disk assembly 131' may be coupled to upper stem coupler 123' of rotor catch stem 111'. In some embodiments, second burst disk assembly 131" may also be coupled to rotor catch stem 111'. Rotor catch stem 111' may include two or more burst disks, depicted in FIG. 8 as upper burst disk 133*a* held in position by burst disk housing 135' and lower burst disk 133*b* held in position by lower burst disk housing 139'. In some embodiments, burst disks 133*a*, 133*b* may be configured such that upper burst disk 133*a* abuts upper rotor catch housing bore 102*a* and lower burst disk 133*b* is in fluid contact with rotor catch stem bore 119'. The bore between upper burst disk 133*a* and lower burst disk 133*b* within rotor catch stem 111 may be defined as intermediate rotor catch stem bore 119". In some embodiments, upper burst disk 133*a* may be configured to rupture once upper burst disk 133*a* is subjected to a first preselected threshold bursting pressure between upper rotor catch housing bore 102*a* and intermediate rotor catch stem bore 119". In some embodiments, lower burst disk 133*b* may be configured to rupture once lower burst disk 133*b* is subjected to a second preselected threshold bursting pressure between intermediate rotor catch stem bore 119" and lower rotor catch housing bore 102*b* after upper burst disk 133*a* is ruptured as discussed further below. In some embodiments, the second preselected threshold bursting pressure may be selected to be higher than the first preselected threshold bursting pressure.

In some embodiments, intermediate rotor catch stem bore 119" may be fluidly coupled to lower rotor catch housing bore 102*b* by exhaust port 137'. In some embodiments, exhaust port 137' may be formed in rotor catch stem 111'. Exhaust port 137' may, in some embodiments, allow fluid to flow from intermediate rotor catch stem bore 119" to lower rotor catch housing bore 102*b* after upper burst disk 133*a* is ruptured. Without being bound to theory, exhaust port 137' may allow a pressure drop after upper burst disk 133*a* is ruptured and may, for example and without limitation, prevent or avoid premature rupture of lower burst disk 133*b* caused by a sudden pressure spike within intermediate rotor catch stem bore 119" when upper burst disk 133*a* is ruptured. Exhaust port 137' may, in some embodiments, allow differential pressure between upper rotor catch housing bore 102*a* and lower rotor catch housing bore 102*b* to be exerted on upper burst disk 133*a* directly when rotor catch stem 111' is in the landed position as further discussed below.

Figure 9:
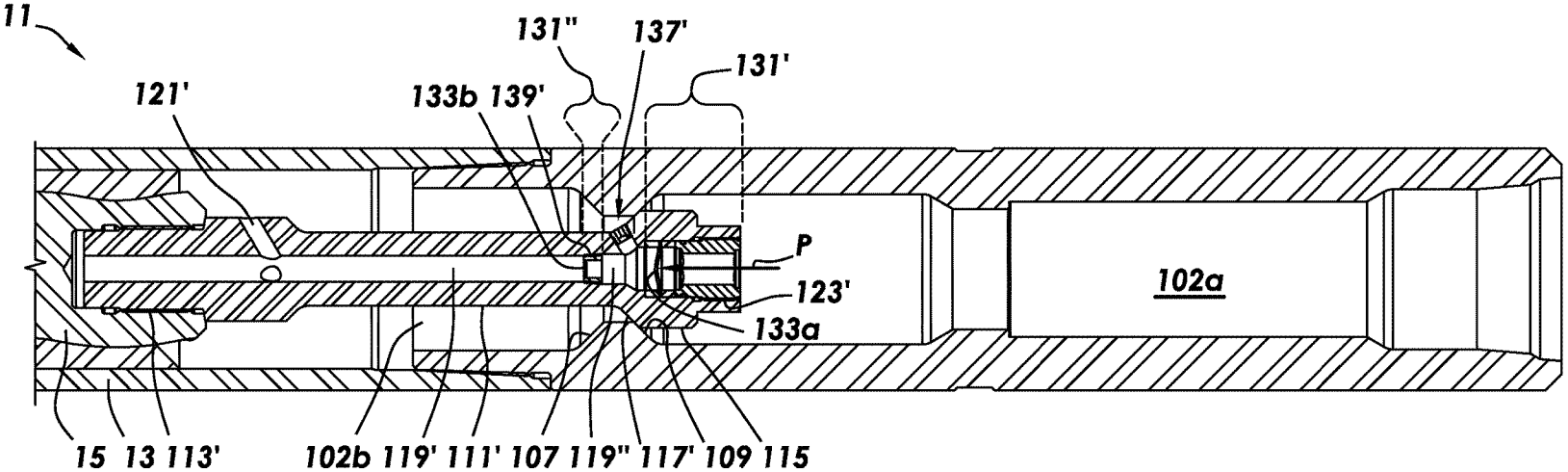
FIG. 9 is a cross section view of the rotor catch assembly of FIG. 8 in a landed position.

As discussed above, in the event that the retention components of BHA 10 fail, when drill string 20 is moved upward, the rotating components of BHA 10 and rotor 15 may not be raised with the rest of drill string until landing flange 115' of rotor catch stem 111' engages landing ring 107 of rotor catch housing 101 as rotor catch stem 111' moves to the landed position as shown in FIG. 9. In such an event, landing face 109, 117' of landing flange 115' and landing ring 107 may come into abutment, allowing rotor 15 and the other rotating components of BHA 10 to be raised with the rest of drill string 20 as landing flange 115' cannot pass through landing ring 107. In some embodiments, the weight of rotor 15 and the other rotating components of BHA 10 may maintain the engagement between landing flange 115' and landing ring 107 such that the flowpath between upper rotor catch housing bore 102*a* and lower rotor catch housing bore 102*b* is closed or restricted. In such a condition, because upper rotor catch housing bore 102*a* is fluidly isolated from lower rotor catch housing bore 102*b* and because rotor catch stem bore 119' is in fluid communication with lower rotor catch housing bore 102*b*, fluid pressure within upper rotor catch housing bore 102*a* is exerted on upper burst disk 133*a*, depicted as pressure p.

Figure 10:
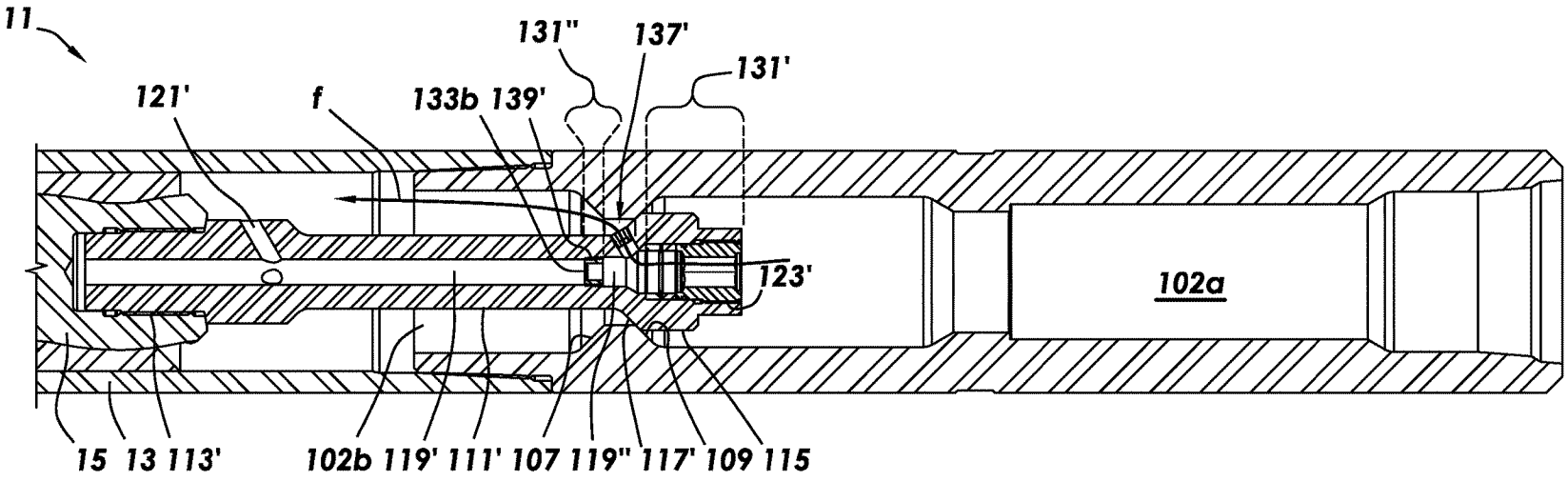
FIG. 10 is a cross section view of the rotor catch assembly of FIG. 9 after rupture of a first burst disk.

Once the pressure differential across upper burst disk 133*a* exceeds the first preselected threshold bursting pressure, upper burst disk 133*a* may rupture as shown in FIG. 10, allowing fluid to flow from upper rotor catch housing bore 102*a* to intermediate rotor catch stem bore 119". The rupture of upper burst disk 133*a* may cause a sudden change in standpipe pressure that is identifiable from the surface and may therefore allow an operator to identify that rotor catch stem 111' is in the landed position and that the retention components of BHA 10 have failed.

Figure 11:
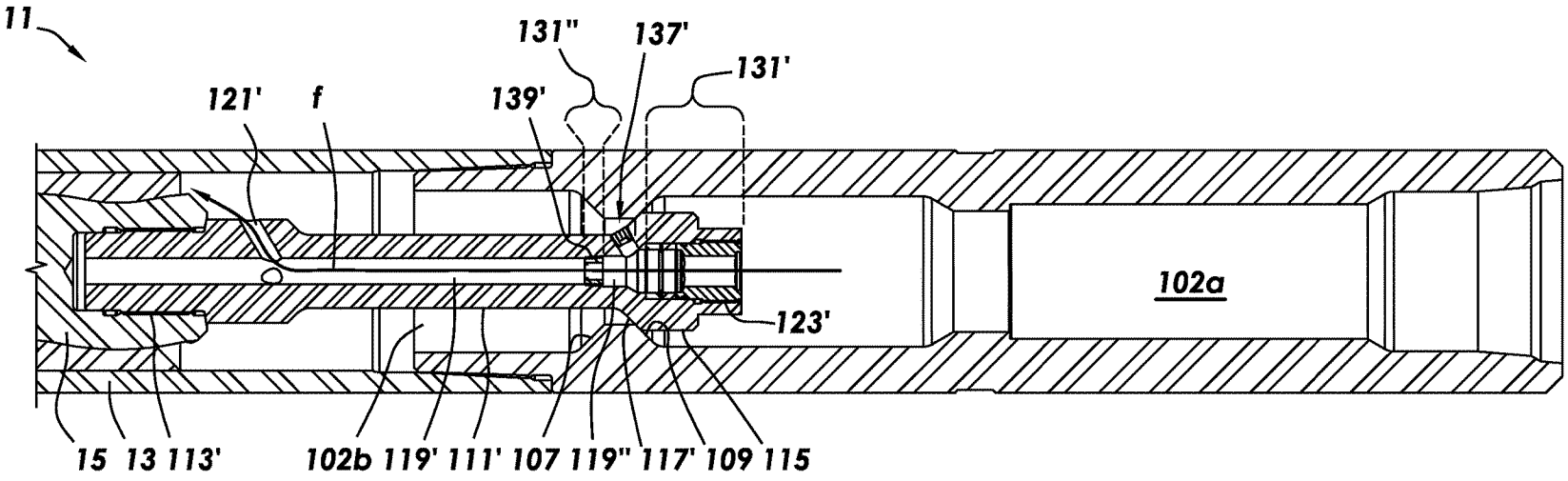
FIG. 11 is a cross section view of the rotor catch assembly of FIG. 10 after rupture of a second burst disk.

In some embodiments, if remedial action is not taken after upper burst disk 133*a* has failed, the standpipe pressure may continue to rise until the standpipe pressure exceeds the second preselected threshold bursting pressure, at which time lower burst disk 133*b* may rupture as shown in FIG. 11. The rupture of lower burst disk 133*b* may cause a second sudden change in standpipe pressure that is identifiable from the surface and may therefore give an operator a second indication that rotor catch stem 111' is in the landed position and that the retention components of BHA 10 have failed. Once lower burst disk 133*b* ruptures, fluid may flow from upper rotor catch housing bore 102*a* to lower rotor catch housing bore 102*b* via intermediate rotor catch stem bore 119", rotor catch stem bore 119', and rotor catch nozzles 121', depicted as flow f. One of ordinary skill in the art with the benefit of this disclosure will understand that any number of burst disks may be similarly included within rotor catch stem 111' consistent with one or more embodiments of the present disclosure.

Figure 12:
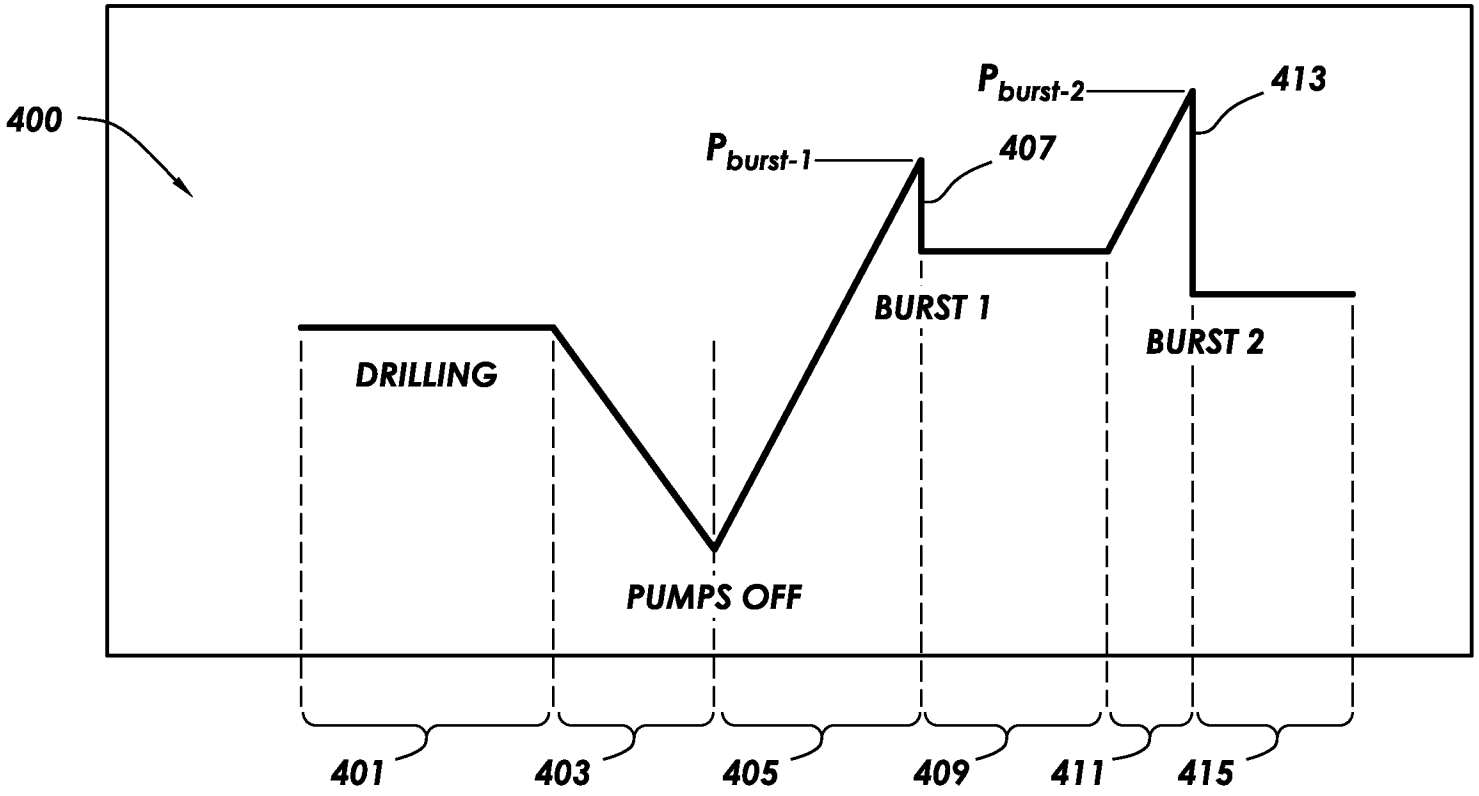
FIG. 12 is a pressure graph depicting expected pressures during a verification operation during which the first and second burst disks rupture.

FIG. 12 depicts the standpipe pressure for drill string 20 coupled to BHA 10 during a BHA integrity verification operation (400) in which the retention components of BHA 10 have failed for an embodiment in which two burst disks are included within rotor catch stem 111'. As discussed herein above with respect to FIG. 4, while drilling, the standpipe pressure remains generally consistent (depicted at 401). During verification operation 400, drilling is stopped, and the pumps providing fluid flow through BHA 10 are disengaged (403). As shown, the standpipe pressure within drill string 20 is reduced. Drill string 20 may be moved upward within the wellbore such that BHA 10 is raised off the bottom of the wellbore, and the pumps may be reengaged (405). However, unlike the normal operation described above with respect to FIG. 4, the standpipe pressure may increase to the first preselected threshold bursting pressure ($P_{burst_1}$) at which point upper burst disk 133*a* ruptures. The rupturing of upper burst disk 133*a* results in a rapid reduction in standpipe pressure (407), after which the standpipe pressure remains relatively constant (409). By observing the rapid reduction in standpipe pressure once the standpipe pressure reaches the first preselected threshold bursting pressure, it can be identified that rotor catch stem 111' is in the landed configuration and the retention components of BHA 10 have failed. If the failure is identified after upper burst disk 133*a* ruptures, remedial actions may be undertaken as discussed herein above. Because upper burst disk 133*a* has ruptured, the flow path between upper rotor catch housing bore 102*a* and lower rotor catch housing bore 102*b* is open via intermediate rotor catch stem bore 119" and exhaust port 137', and fluid circulation through BHA 10 may continue as BHA 10 is removed from the wellbore.

If the pumps supplying fluid to BHA 10 continue to again increase the standpipe pressure within the drill string (411), once the standpipe pressure increases to the second preselected threshold bursting pressure ($P_{burst_2}$), lower burst disk 133*b* may rupture. The rupturing of lower burst disk 133*b* results in a second rapid reduction in standpipe pressure (413), after which the standpipe pressure remains relatively constant (415). By observing the second rapid reduction in standpipe pressure once the standpipe pressure reaches the second preselected threshold bursting pressure, an operator may have a second chance or may receive confirmation that rotor catch stem 111' is in the landed configuration and the retention components of BHA 10 have failed. Once the failure is identified, remedial actions may be undertaken as discussed herein above. Because both upper burst disk 133*a* and lower burst disk 133*b* have ruptured, the flow path between upper rotor catch housing bore 102*a* and lower rotor catch housing bore 102*b* is open via intermediate rotor catch stem bore 119", rotor catch stem bore 119', and rotor catch nozzles 121' and fluid circulation through BHA 10 may continue as BHA 10 is removed from the wellbore.

Figure 13:
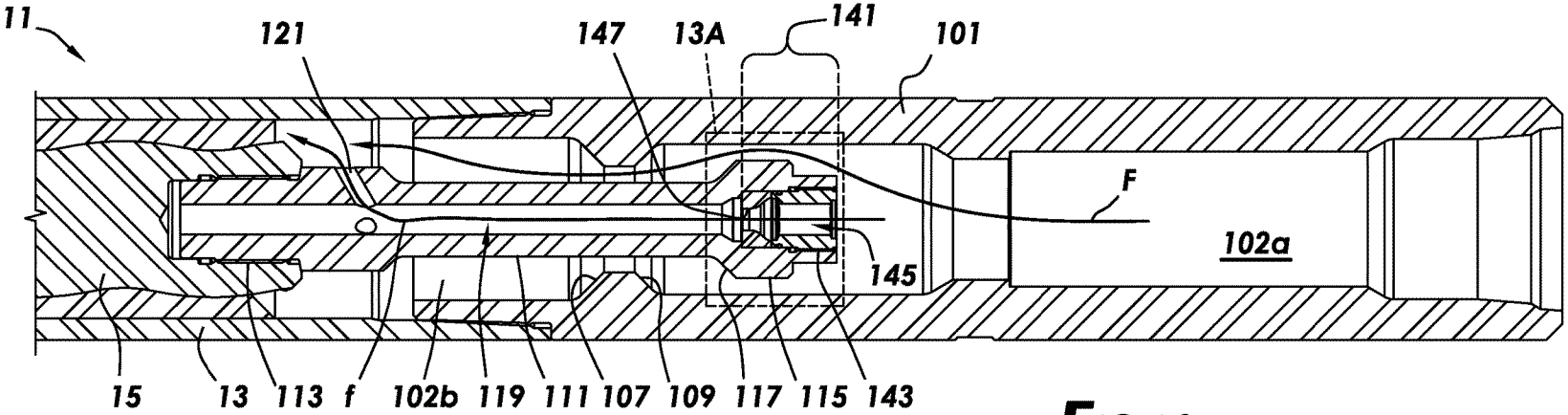
FIG. 13 is a cross section view of a rotor catch assembly consistent with at least one embodiment of the present disclosure.
Figure 13A:
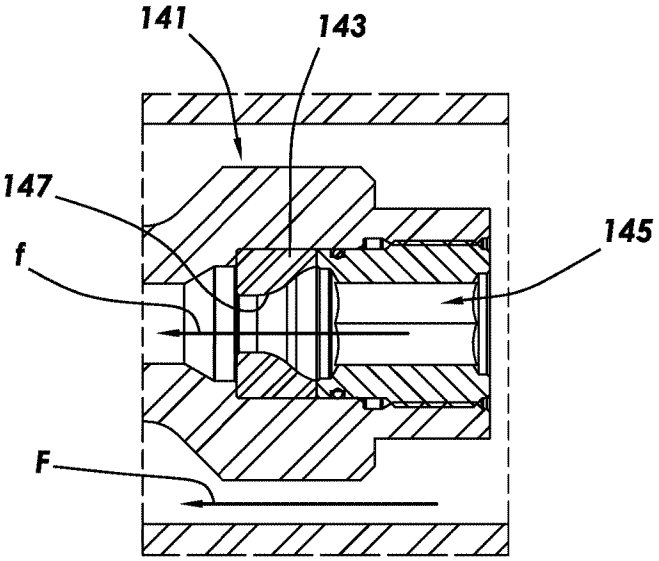
FIG. 13A is a detail view of the rotor catch assembly of FIG. 13.

As shown in FIGS. 13, 13A, in some embodiments, rotor catch assembly 100 may include nozzle assembly 141 coupled to upper stem coupler 123 of rotor catch stem 111. Nozzle assembly 141 may include nozzle body 143. Nozzle body 143 may be tubular, the interior of which defining nozzle bore 145. Nozzle bore 145 may provide fluid communication between upper rotor catch housing bore 102*a* and lower rotor catch housing bore 102*b* via rotor catch stem bore 119 and rotor catch nozzles 121, depicted as flow f. In some embodiments, nozzle bore 145 may include a restriction of a known total flow area (TFA), referred to herein as restricted TFA 147. When in the normal operation wherein rotor catch stem 111 is not in the landed position, the majority of the flow through rotor catch assembly 100 may flow through landing ring 107 around rotor catch stem 111, depicted as flow F.

Figure 14:
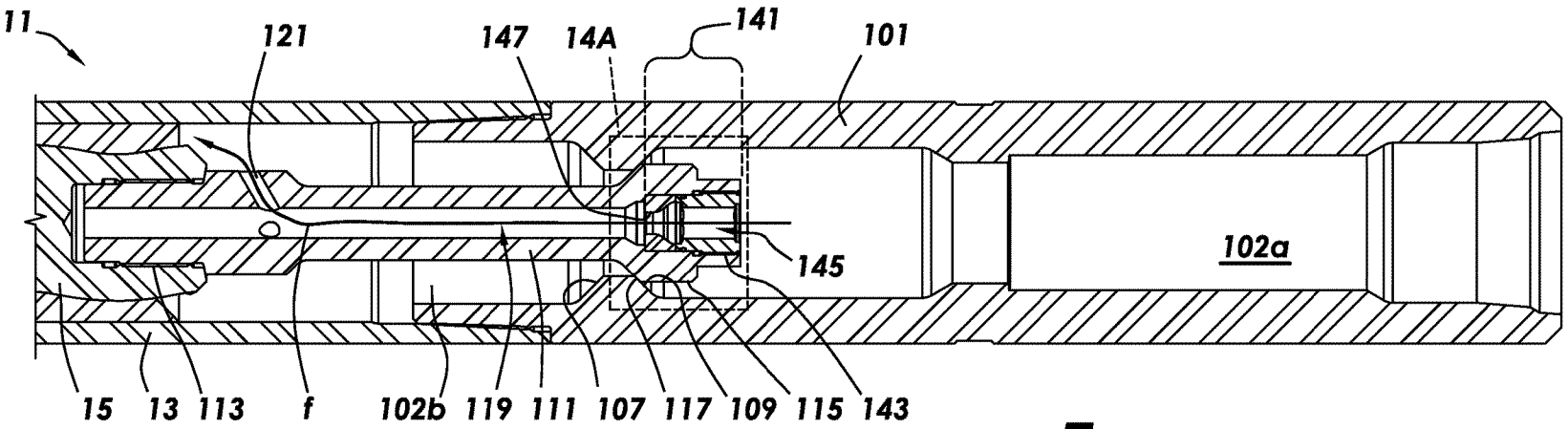
FIG. 14 is a cross section view of the rotor catch assembly of FIG. 13 in a landed position.
Figure 14A:
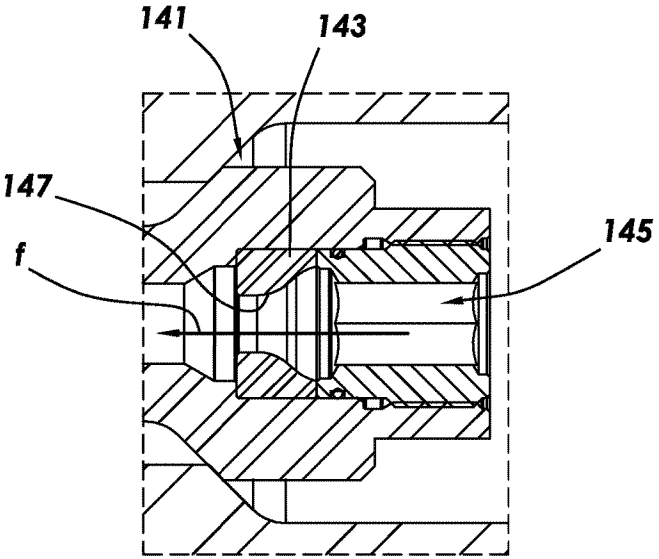
FIG. 14A is a detail view of the rotor catch assembly of FIG. 14.

As discussed above, in the event that the retention components of BHA 10 fail, when drill string 20 is moved upward, the rotating components of BHA 10 and rotor 15 may not be raised with the rest of drill string until landing flange 115 of rotor catch stem 111 engages landing ring 107 of rotor catch housing 101 as rotor catch stem 111 moves to the landed position as shown in FIGS. 14, 14A. In such an event, landing face 109, 117 of landing flange 115 and landing ring 107 may come into abutment, allowing rotor 15 and the other rotating components of BHA 10 to be raised with the rest of drill string 20 as landing flange 115 cannot pass through landing ring 107. In some embodiments, the weight of rotor 15 and the other rotating components of BHA 10 may maintain the engagement between landing flange 115 and landing ring 107 such that the flowpath between upper rotor catch housing bore 102*a* and lower rotor catch housing bore 102*b* through landing ring 107 around rotor catch stem 111 is closed or restricted. In such a condition, fluid flow through rotor catch assembly 100 may only flow through nozzle bore 145 and restricted TFA 147, depicted as flow f. By knowing the TFA of restricted TFA 147 and properties of the fluid passing through restricted TFA 147, the standpipe pressure resulting from fluid flow through rotor catch assembly 100 when rotor catch stem 111 is in the landed position may be estimated, allowing for the identification of the failure of BHA 10 during a BHA integrity verification operation as discussed below.

Figure 15:
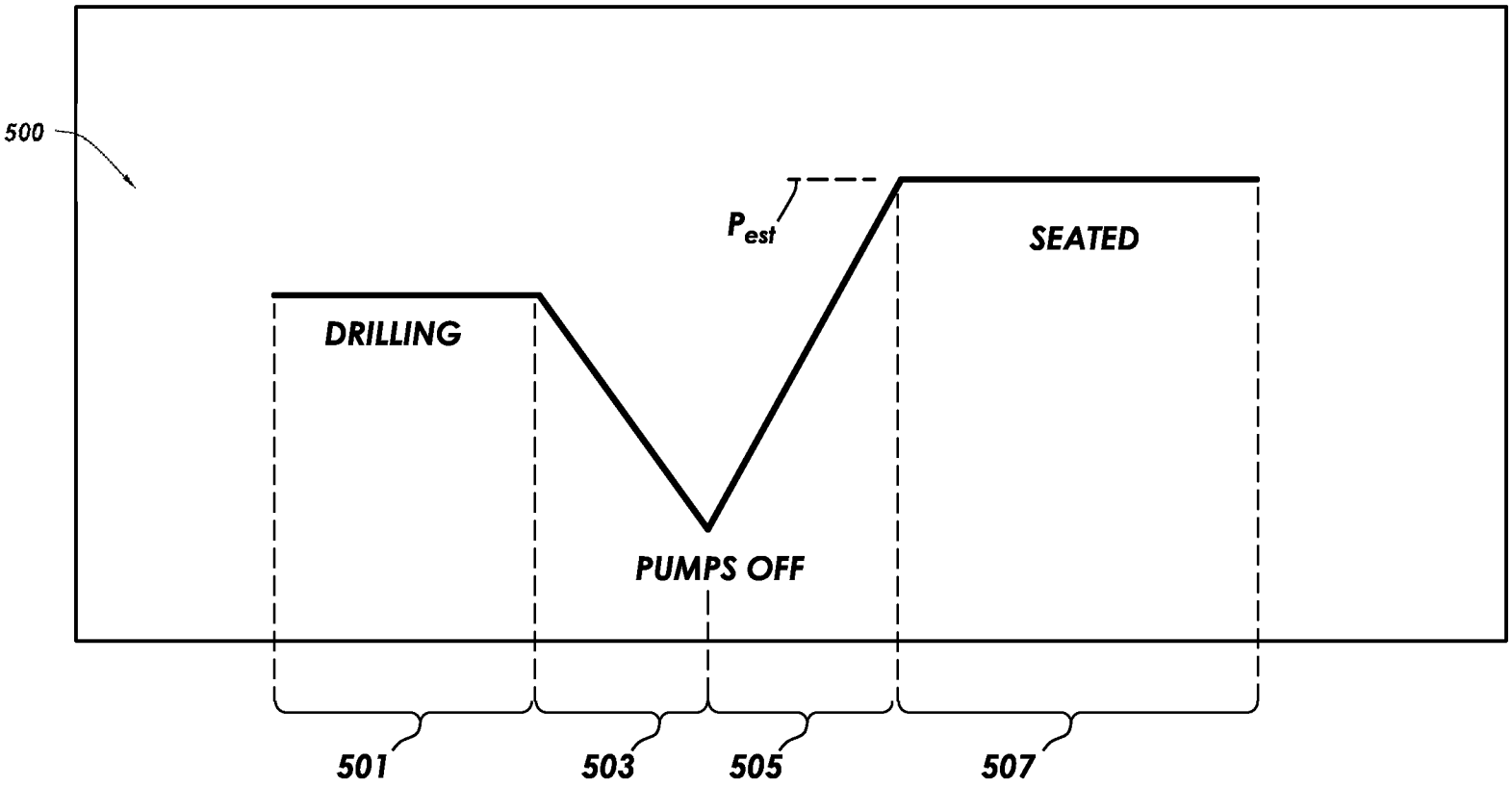
FIG. 15 is a pressure graph depicting expected pressures during a verification operation of the rotor catch assembly of FIG. 14 when in the landed position.

FIG. 15 depicts the standpipe pressure for drill string 20 coupled to BHA 10 during a BHA integrity verification operation (500) in which the retention components of BHA 10 have failed. As discussed herein above with respect to FIG. 4, while drilling, the standpipe pressure remains generally consistent (depicted at 501). During verification operation 500, drilling is stopped, and the pumps providing fluid flow through BHA 10 are disengaged (503). As shown, the standpipe pressure within drill string 20 is reduced. Drill string 20 may be moved upward within the wellbore such that BHA 10 is raised off the bottom of the wellbore, and the pumps may be reengaged (505). However, unlike the normal operation described above with respect to FIG. 4, the standpipe pressure may increase to the estimated standpipe pressure (Pest) corresponding to the TFA of restricted TFA 147 which may be above the standpipe pressure encountered during off-bottom flow ($P_{off\text{-}bottom}$) when rotor catch stem 111 is not in the landed position (507). By observing the increase of standpipe pressure to the estimated standpipe pressure, it can be identified that rotor catch stem 111 is in the landed position and the retention components of BHA 10 have failed.

Once the failure is identified, remedial actions may be undertaken as discussed herein above. Because a flowpath between upper rotor catch housing bore 102*a* and lower rotor catch housing bore 102*b* via nozzle bore 145, rotor catch stem bore 119, and rotor catch nozzles 121, fluid circulation through BHA 10 may continue as BHA 10 is removed from the wellbore.

Figure 16:
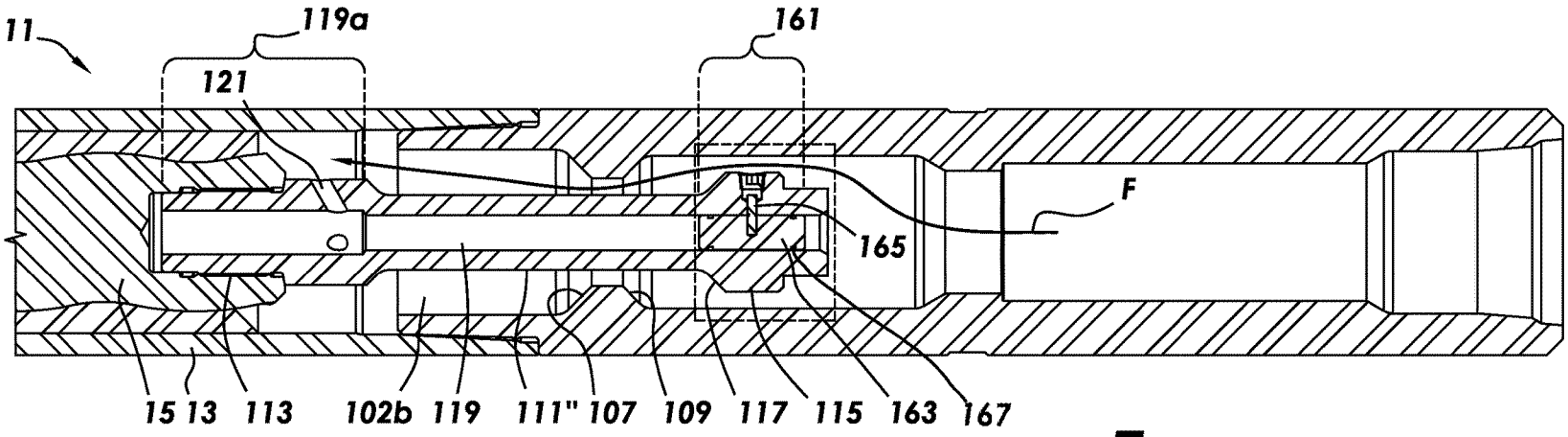
FIG. 16 is a cross section view of a rotor catch assembly consistent with at least one embodiment of the present disclosure.
Figure 16A:
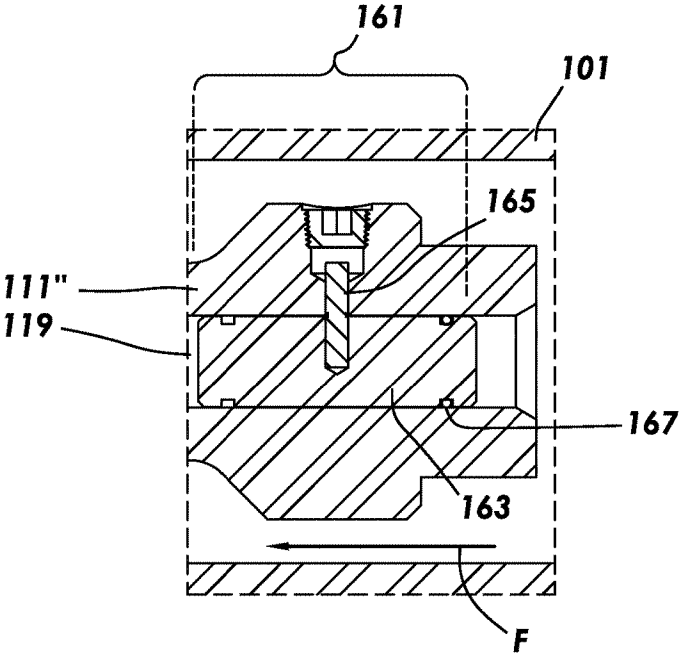
FIG. 16A is a detail view of the rotor catch assembly of FIG. 16.

As shown in FIGS. 16, 16A, in some embodiments, rotor catch assembly 100 may include piston assembly 161. Piston assembly 161 may include piston 163 positioned within rotor catch stem bore 119 of rotor catch stem 111". In some embodiments, piston assembly 161 may include shear pin 165. Shear pin 165 may couple between rotor catch stem 111" and piston 163. Shear pin 165 may retain piston 163 at a position within rotor catch stem bore 119 such that the flow path through rotor catch stem bore 119 is closed, referred to herein as the closed position. Shear pin 165 may be designed to shear once the differential pressure exerted on piston 163 reaches a preselected threshold shear pressure. Once shear pin 165 shears, piston 163 may be able to move within rotor catch stem bore 119 in response to differential pressure exerted thereon as further discussed below. In some embodiments, one or more seals 167 may be positioned between piston 163 and rotor catch stem 111".

When in the normal operation wherein rotor catch stem 111" is not in the landed position, flow through rotor catch assembly 100 may flow through landing ring 107 around rotor catch stem 111", depicted as flow F. During such normal operation, the pressure within upper rotor catch housing bore 102*a* and rotor catch stem bore 119 is equalized as rotor catch stem bore 119 is in fluid communication with lower rotor catch housing bore 102*b* through rotor catch nozzles 121. Therefore, during normal operation, piston 163 does not experience significant differential pressure and remains in the closed position.

Figure 17:
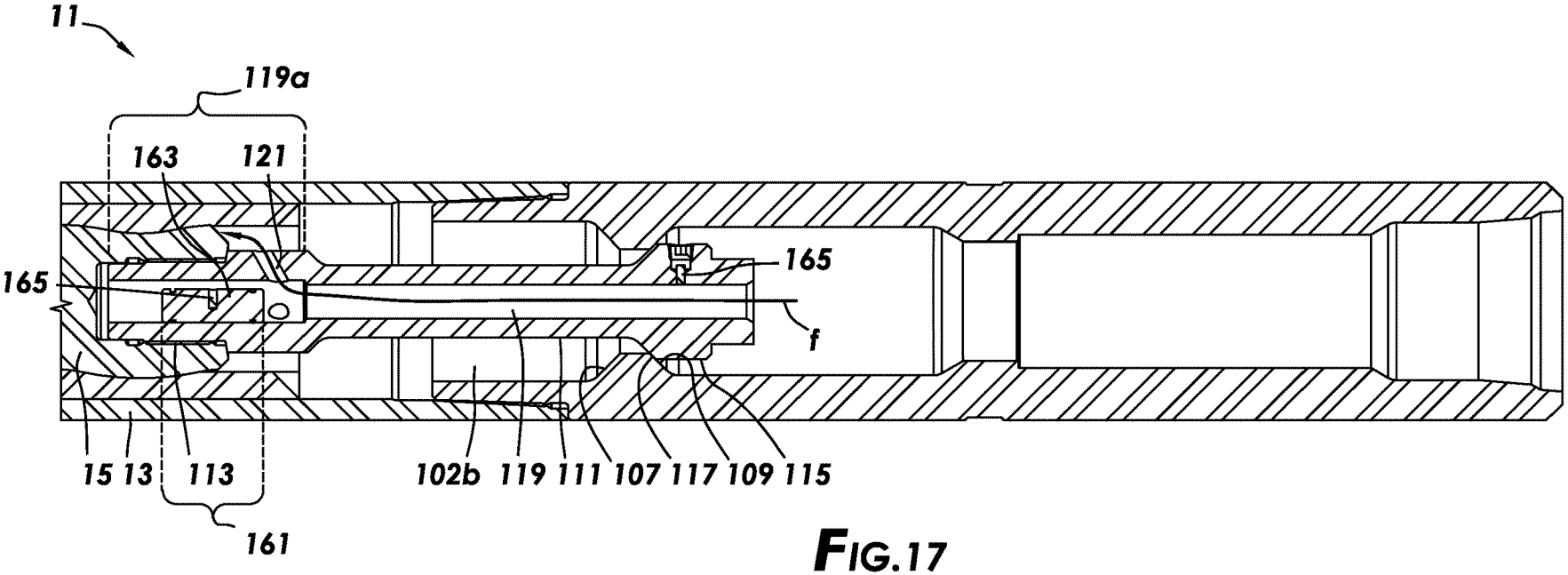
FIG. 17 is a cross section view of the rotor catch assembly of FIG. 16 in the landed and open position.

As discussed above, in the event that the retention components of BHA 10 fail, when drill string 20 is moved upward, the rotating components of BHA 10 and rotor 15 may not be raised with the rest of drill string until landing flange 115 of rotor catch stem 111" engages landing ring 107 of rotor catch housing 101 as rotor catch stem 111" moves to the landed position as shown in FIG. 17. In such an event, landing face 109, 117 of landing flange 115 and landing ring 107 may come into abutment, allowing rotor 15 and the other rotating components of BHA 10 to be raised with the rest of drill string 20 as landing flange 115 cannot pass through landing ring 107. In some embodiments, the weight of rotor 15 and the other rotating components of BHA 10 may maintain the engagement between landing flange 115 and landing ring 107 such that fluid flow the flowpath between upper rotor catch housing bore 102*a* and lower rotor catch housing bore 102*b* through landing ring 107 around rotor catch stem 111" is closed or restricted.

In such a condition, because upper rotor catch housing bore 102*a* is fluidly isolated from lower rotor catch housing bore 102*b* and because rotor catch stem bore 119 is in fluid communication with lower rotor catch housing bore 102*b*, fluid pressure within upper rotor catch housing bore 102*a* is exerted on piston 163. Once the pressure differential across piston 163 reaches the preselected threshold shear pressure, shear pin 165 may shear, allowing piston 163 to move within rotor catch stem bore 119. As shown in FIG. 17, piston 163 may be pushed through rotor catch stem bore 119 downward until piston 163 passes rotor catch nozzles 121, allowing fluid flow from upper rotor catch housing bore 102*a* to lower rotor catch housing bore 102*b* via rotor catch stem bore 119 and rotor catch nozzles 121, depicted as flow f.

In some embodiments, rotor catch stem bore 119 may include an area of larger diameter, depicted as widened bore 119*a*. In some such embodiments, once piston 163 enters widened bore 119*a* of rotor catch stem bore 119, differential pressure across piston 163 may equalize. Such equalization may, without being bound to theory, reduce the likelihood that piston 163 is pushed back into the closed position or a partially closed position by built-up fluid pressure on the lower side of piston 163.

Figure 18:
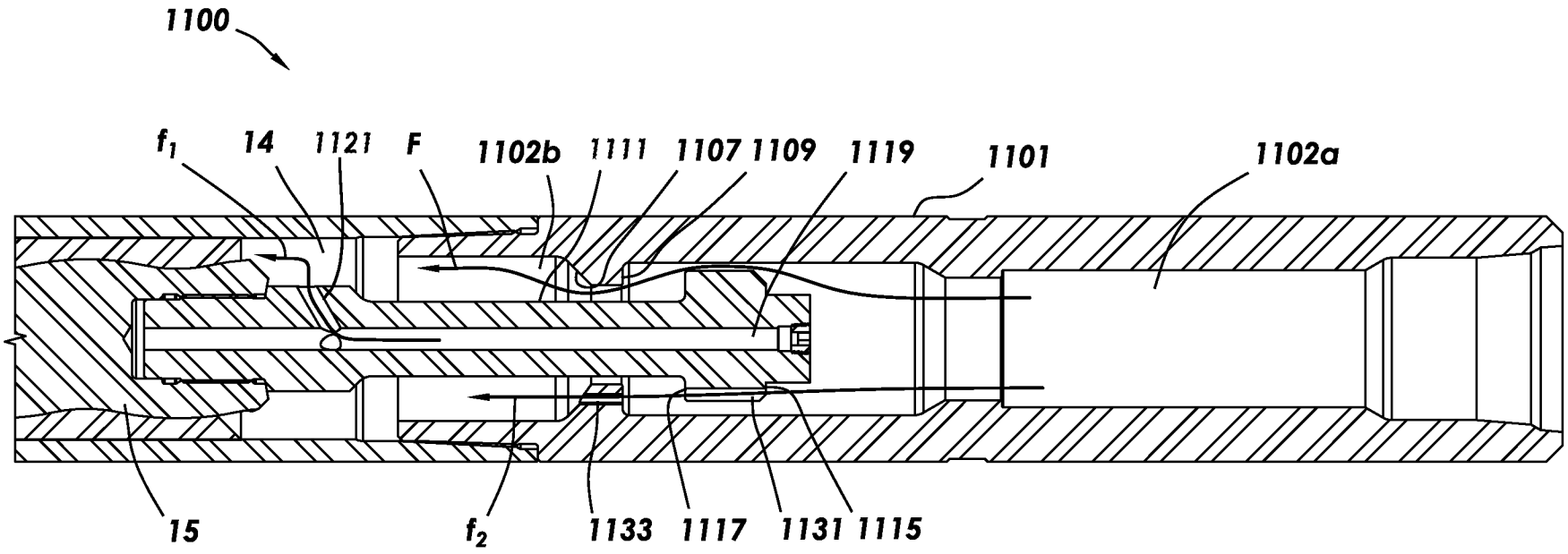
FIG. 18 is a cross section view of a rotor catch assembly consistent with at least one embodiment of the present disclosure.

In some embodiments, as shown in FIG. 18, rotor catch assembly 1100 may include rotor catch stem 1111 positioned within rotor catch housing 1101. In some such embodiments, landing ring 1107 of rotor catch housing 1101 may include port 1133 formed therethrough. Port 1133 may fluidly couple between upper rotor catch housing bore 1102*a* and lower rotor catch housing bore 1102*b*.

In some embodiments, rotor catch stem 1111 may include slot 1131. Slot 1131 may be formed in landing flange 1115 and may at least partially extend along landing flange 1115. Slot 1131 may extend to landing face 1117 of landing flange 1115 such that slot 1131 may provide a flowpath between upper rotor catch housing bore 1102*a* and landing face 1117 of landing flange 1115 as further described below.

In some embodiments, rotor catch stem 1111 may be tubular, the interior of which defining rotor catch stem bore 1119. In some embodiments, one or more rotor catch nozzles 1121 may be formed in rotor catch stem 1111 to provide a flowpath between rotor catch stem bore 1119 and lower rotor catch housing bore 1102*b* or stator bore 14.

During normal operation as depicted in FIG. 18, the retention components of BHA 10 properly retain rotor 15 in the proper position such that landing flange 1115 of rotor catch stem 1111 is positioned within upper rotor catch housing bore 1102*a* spaced apart from landing ring 1107 such that fluid may flow through landing ring 1107 from upper rotor catch housing bore 1102*a* to lower rotor catch housing bore 1102*b* and into stator bore 14 regardless of whether BHA 10 is landed on the bottom of the wellbore or raised off bottom. Such flow, depicted by arrow F, may, for example and without limitation, be used to operate power section 11 of BHA 10 and any other equipment of BHA 10. In some embodiments, fluid may flow through rotor catch stem bore 1119, depicted as flow $f_1$, and port 1133, depicted as flow $f_2$, while rotor catch stem 1111 is not in the landed position.

Figure 19:
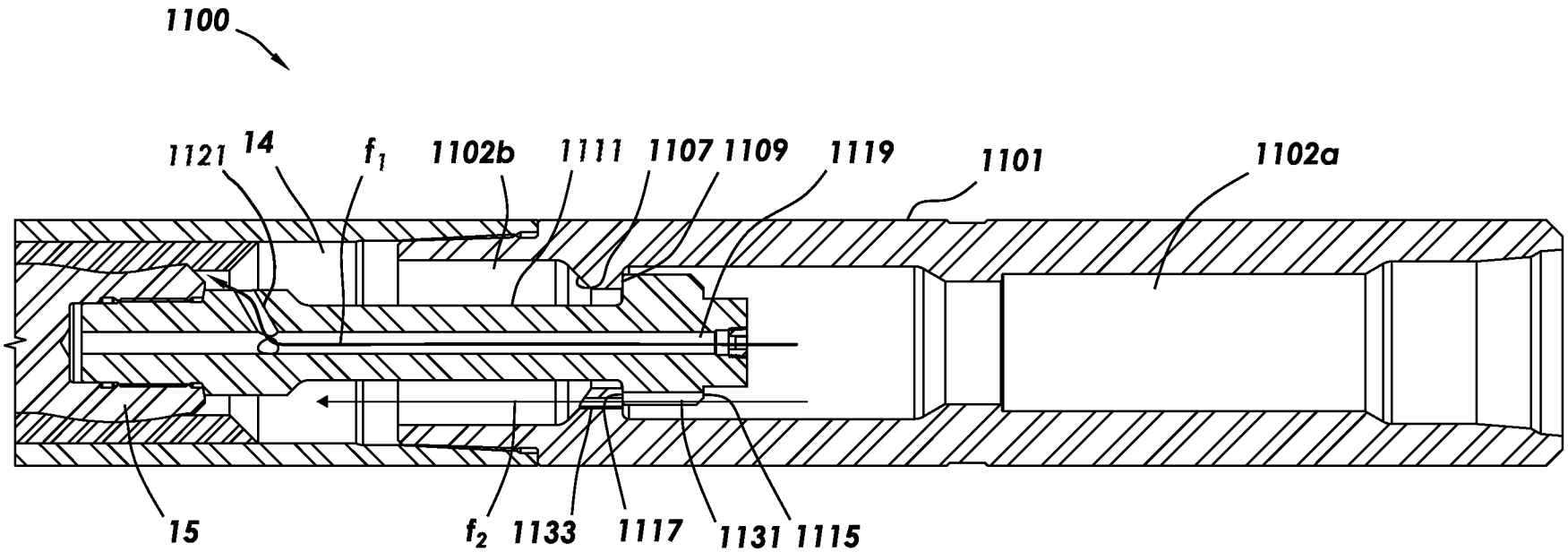
FIG. 19 is a cross section view of the rotor catch assembly of FIG. 18 in a landed position.

In the event that the retention components of BHA 10 fail, when drill string 20 is moved upward, the rotating components of BHA 10 and rotor 15 may not be raised with the rest of drill string until landing flange 1115 of rotor catch stem 1111 engages landing ring 1107 of rotor catch housing 1101, defining a landed position of rotor catch stem 1111 as shown in FIG. 19. In such an event, landing faces 1117, 1109 of landing flange 1115 and landing ring 1107 may come into abutment, allowing rotor 15 and the other rotating components of BHA 10 to be raised with the rest of drill string 20 as landing flange 1115 cannot pass through landing ring 1107. In some embodiments, the weight of rotor 15 and the other rotating components of BHA 10 may maintain the engagement between landing flange 1115 and landing ring 1107 such that fluid flow through the flowpath between upper rotor catch housing bore 1102*a* and lower rotor catch housing bore 1102*b* through landing ring 1107 is closed or restricted. Fluid may continue to flow between upper rotor catch housing bore 1102*a* and lower rotor catch housing bore 1102*b* through rotor catch stem bore 1119 and rotor catch nozzles 1121, depicted as flow $f_1$.

Figure 19B:
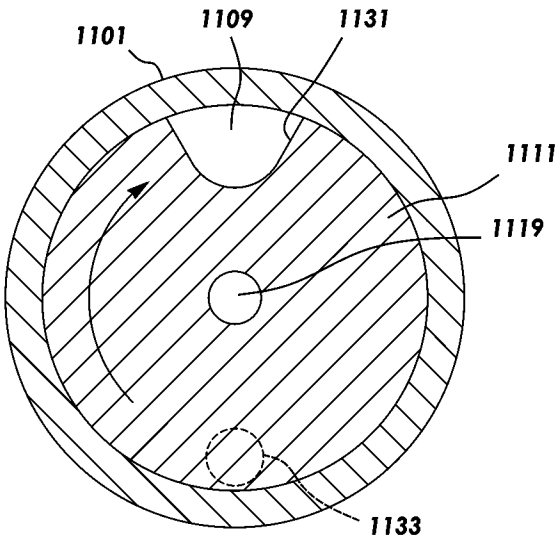
FIGS. 19A, 19B are cross section views of the rotor catch assembly of FIG. 18 during operation.
Figure 19A:
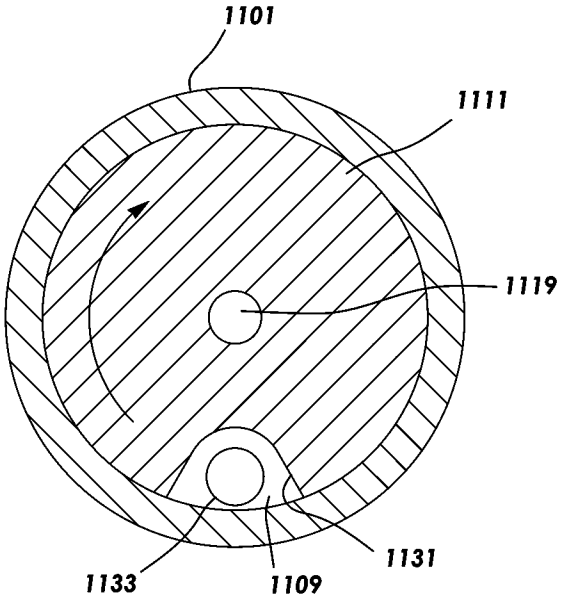

In some embodiments, as rotor catch stem 1111 is coupled to rotor 15, rotor catch stem 1111 may rotate in response to the rotation of rotor 15 caused by flow $f_1$ as it passes through power section 11. Such rotation may, in some embodiments, cause slot 1131 to move into and out of alignment with port 1133. When slot 1131 is aligned with port 1133, as shown in FIGS. 19, 19A, fluid may flow through port 1133 as slot 1131 provides a flowpath between upper rotor catch housing bore 1102*a* and port 1133, depicted as flow $f_2$. When slot 1131 is not aligned with port 1133, as depicted in FIG. 19B, fluid flow through port 1133 may be prevented. The addition of the flowpath through port 1133 when slot 1131 is aligned with port 1133 may, in some embodiments, reduce the standpipe pressure within drill string 20 as compared to the standpipe pressure when slot 1131 is not aligned with port 1133. Continued rotation of rotor catch stem 1111 in response to the flow through rotor catch assembly 1100 may therefore generate a recognizable pressure pulse train in the standpipe pressure of drill string 20 when rotor catch stem 1111 is in the landed position.

Figure 20:
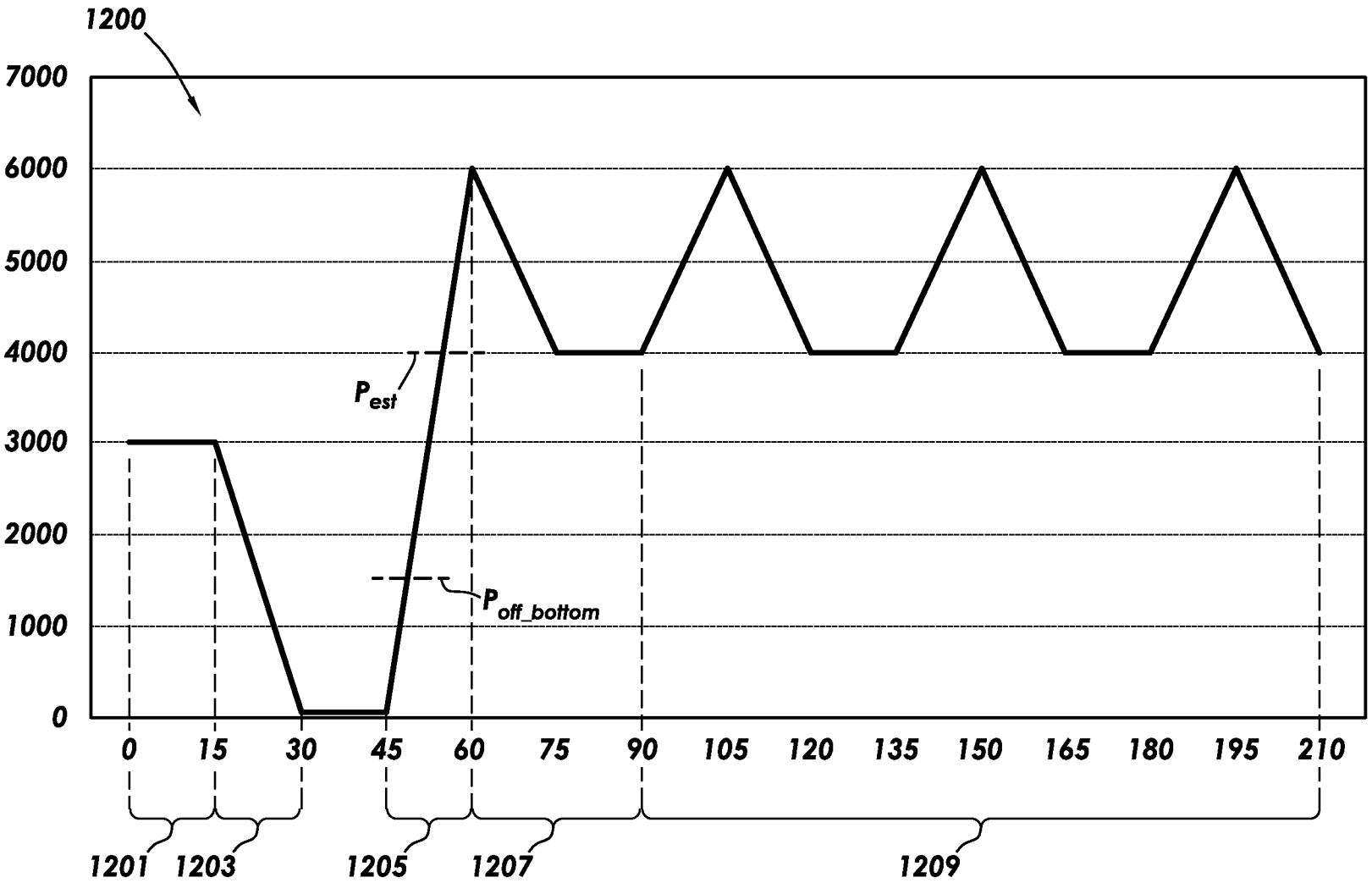
FIG. 20 is a pressure graph depicting expected pressures during a verification operation of the rotor catch assembly of FIG. 18 when in the landed position.

FIG. 20 depicts the standpipe pressure for drill string 20 coupled to BHA 10 during a BHA integrity verification operation (1200) in which the retention components of BHA 10 have failed. As discussed herein above with respect to FIG. 4, while drilling, the standpipe pressure remains generally consistent (depicted at 1201). During verification operation 1200, drilling is stopped, and the pumps providing fluid flow through BHA 10 are disengaged (1203). As shown, the standpipe pressure within drill string 20 is reduced. Drill string 20 may be moved upward within the wellbore such that BHA 10 is raised off the bottom of the wellbore, and the pumps may be reengaged (1205). However, unlike the normal operation described above with respect to FIG. 4, the standpipe pressure may increase to a higher standpipe pressure commensurate with the reduced flow area afforded by rotor catch stem bore 1119, which may be above the standpipe pressure encountered during off-bottom flow (Poll-boom) when rotor catch stem 1111 is not in the landed position (1207). Continued fluid flow may cause slot 1131 to move into and out of alignment with port 1133 due to the rotation of rotor catch stem 1111, causing a series of pressure pulses to be imposed on the standpipe pressure (1209). By observing the increase of standpipe pressure above the standpipe pressure encountered during off-bottom flow and the pressure pulses caused by the rotation of rotor catch stem 1111, it can be identified that rotor catch stem 1111 is in the landed position and the retention components of BHA 10 have failed.

Once the failure is identified, remedial actions may be undertaken as discussed herein above. Because a flowpath between upper rotor catch housing bore 1102*a* and lower rotor catch housing bore 1102*b* via rotor catch stem bore 1119 and rotor catch nozzles 121 and port 1133 when aligned with slot 1131, fluid circulation through BHA 10 may continue as BHA 10 is removed from the wellbore.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A rotor catch assembly comprising:

a rotor catch housing, the rotor catch housing being tubular, the rotor catch housing including a landing ring, the landing ring formed on an inner surface of the rotor catch housing, the interior of the rotor catch housing above the landing ring defining an upper rotor catch housing bore, the interior of the rotor catch housing below the landing ring defining a lower rotor catch housing bore;

a rotor catch stem, the rotor catch stem being tubular, the interior of the rotor catch stem defining a rotor catch stem bore, the rotor catch stem including a landing flange, the landing flange being an annular projection about an upper end of the rotor catch stem, the rotor catch stem positioned within the rotor catch housing such that the landing flange is positioned in the upper rotor catch housing bore, the rotor catch stem including a rotor catch nozzle, the rotor catch nozzle providing a flowpath between the rotor catch stem bore and the lower rotor catch housing bore; and a pressure-actuatable assembly located in and preventing flow along a flowpath between the upper rotor catch housing bore and the rotor catch stem bore, wherein a predetermined pressure in the upper rotor catch housing bore opens the pressure-actuatable assembly so as to allow flow from the upper rotor catch housing bore to the rotor catch stem bore.

2. The rotor catch assembly of claim 1, wherein the pressure-actuatable assembly comprises a piston assembly, the piston assembly including a piston and a shear pin, the piston positioned within the rotor catch stem bore, the shear pin coupled between the rotor catch stem and the piston such that the flowpath through the rotor catch stem bore is closed while the piston is coupled to the rotor catch stem by the shear pin, and wherein the rotor catch stem bore comprises an area of larger diameter defining a widened bore, the widened bore having a diameter larger than the diameter of the piston.

3. The rotor catch assembly of claim 2, further comprising one or more seals positioned between the piston and the rotor catch stem bore.

4. The rotor catch assembly of claim 1 wherein the pressure-actuated assembly comprises a burst disk assembly, the burst disk assembly including a burst disk and a burst disk housing, the burst disk housing coupled to the rotor catch stem such that the burst disk is held in the rotor catch stem bore such that the flowpath through the rotor catch stem bore is closed while the burst disk is intact.

5. The rotor catch assembly of claim 4, wherein the burst disk is adapted to burst when the differential pressure between the upper rotor catch housing bore and the lower rotor catch housing bore is above a first preselected threshold bursting pressure.

6. The rotor catch assembly of claim 4, further comprising a second burst disk assembly, the second burst disk assembly including a burst disk housing and a lower burst disk, the lower burst disk positioned within the rotor catch stem bore such that portion of the rotor catch stem bore between the lower burst disk and the upper burst disk defines an intermediate rotor catch stem bore, wherein the flowpath between the intermediate rotor catch stem bore and the rotor catch stem bore is closed while the lower burst disk is intact.

7. The rotor catch assembly of claim 6, further comprising an exhaust port, the exhaust port formed in the rotor catch stem, the exhaust port providing fluid communication between the intermediate rotor catch stem bore and the lower rotor catch housing bore.

8. The rotor catch assembly of claim 6, wherein the lower burst disk is adapted to burst when the differential pressure between the intermediate rotor catch stem bore and the lower rotor catch housing bore is above a second preselected threshold bursting pressure.

9. A rotor catch assembly comprising:

a rotor catch housing, the rotor catch housing being tubular, the rotor catch housing including a landing ring, the landing ring formed on an inner surface of the rotor catch housing, the interior of the rotor catch housing above the landing ring defining an upper rotor catch housing bore, the interior of the rotor catch housing below the landing ring defining a lower rotor catch housing bore;

a rotor catch stem, the rotor catch stem being tubular, the interior of the rotor catch stem defining a rotor catch stem bore, the rotor catch stem including a landing flange, the landing flange being an annular projection about an upper end of the rotor catch stem, the rotor catch stem positioned within the rotor catch housing such that the landing flange is positioned in the upper rotor catch housing bore, the rotor catch stem including a rotor catch nozzle, the rotor catch nozzle providing a flowpath between the rotor catch stem bore and the lower rotor catch housing bore; and a nozzle assembly, the nozzle assembly including a nozzle body, the nozzle body being tubular, the interior of the nozzle body defining a nozzle bore, the nozzle body coupled to the rotor catch stem such that the nozzle bore defines a flowpath between the upper rotor catch housing bore and the rotor catch stem bore.

10. The rotor catch assembly of claim 9, wherein the nozzle bore comprises a known total flow area at a location along the nozzle bore defining a restricted total flow area.

11. The rotor catch assembly of claim 9, wherein:

the landing ring comprises a port formed therethrough, the port providing a flowpath between the upper rotor catch housing bore and the lower rotor catch housing bore;

the landing flange comprises a slot, the slot adapted to, as the rotor catch stem is rotated, rotate into and out of alignment with the port such that a recognizable pressure pulse is generated by the rotor catch assembly.

12. A method comprising:

positioning a bottomhole assembly (BHA) in a wellbore, the BHA coupled to a drill string, the BHA including:

a power section including a stator and a rotor; and a rotor catch, the rotor catch including:

a rotor catch housing, the rotor catch housing being tubular, the rotor catch housing including a landing ring, the landing ring formed on an inner surface of the rotor catch housing, the interior of the rotor catch housing above the landing ring defining an upper rotor catch housing bore, the interior of the rotor catch housing below the landing ring defining a lower rotor catch housing bore, the rotor catch housing coupled to the stator; and a rotor catch stem, the rotor catch stem being tubular, the interior of the rotor catch stem defining a rotor catch stem bore, the rotor catch stem including a landing flange, the landing flange being an annular projection about an upper end of the rotor catch stem, the rotor catch stem positioned within the rotor catch housing such that the landing flange is positioned in the upper rotor catch housing bore, the rotor catch stem including a rotor catch nozzle, the rotor catch nozzle providing a flowpath between the rotor catch stem bore and the lower rotor catch housing bore, the rotor catch stem coupled to the rotor; and a restriction positioned within the rotor catch stem bore, the restriction reducing or preventing fluid flow through the rotor catch stem bore;

raising the BHA off the bottom of the wellbore;

landing the landing flange of the rotor catch stem on the landing ring of the rotor catch housing;

pumping fluid into the drill string;

monitoring a standpipe pressure of the drill string;

opening the restriction; and identifying that the restriction has opened.

13. The method of claim 12, wherein the restriction comprises a burst disk assembly, the burst disk assembly including a burst disk and a burst disk housing, the burst disk housing coupled to the rotor catch stem such that the burst disk is held in the rotor catch stem bore such that the flowpath through the rotor catch stem bore is closed while the burst disk is intact, and wherein the step of opening the restriction comprises:

increasing the standpipe pressure above a first preselected threshold bursting pressure;

bursting the burst disk; and allowing fluid flow through the rotor catch stem bore.

14. The method of claim 13, wherein the rotor catch further comprises a second burst disk assembly, the second burst disk assembly including a burst disk housing and a lower burst disk, the lower burst disk positioned within the rotor catch stem bore such that portion of the rotor catch stem bore between the lower burst disk and the upper burst disk defines an intermediate rotor catch stem bore, wherein the flowpath between the intermediate rotor catch stem bore and the rotor catch stem bore is closed while the lower burst disk is intact, and wherein the method further comprises:

increasing the standpipe pressure above a second preselected threshold bursting pressure;

bursting the lower burst disk; and allowing fluid flow through the rotor catch stem bore.

15. The method of claim 12, wherein the restriction comprises a piston assembly, the piston assembly including a piston and a shear pin, the piston positioned within the rotor catch stem bore, the shear pin coupled between the rotor catch stem and the piston such that the flowpath through the rotor catch stem bore is closed while the piston is coupled to the rotor catch stem by the shear pin, and wherein the step of opening the restriction comprises:

increasing the standpipe pressure above a first preselected threshold shear pressure;

shearing the shear pin;

moving the piston within the rotor catch stem bore until the flowpath through the rotor catch stem bore is open; and allowing fluid flow through the rotor catch stem bore.

* * * * *